US010380940B2

(12) United States Patent
Lee et al.

(10) Patent No.: US 10,380,940 B2
(45) Date of Patent: Aug. 13, 2019

(54) ORGANIC LIGHT-EMITTING DIODE DISPLAY

(71) Applicant: Samsung Display Co., Ltd., Yongin-si, Gyeonggi-do (KR)

(72) Inventors: Seungkyu Lee, Yongin-si (KR); Taehoon Kwon, Yongin-si (KR); Wonkyu Kwak, Yongin-si (KR); Jintae Jeong, Yongin-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 0 days.

(21) Appl. No.: 15/356,477

(22) Filed: Nov. 18, 2016

(65) Prior Publication Data

US 2017/0148384 A1 May 25, 2017

(30) Foreign Application Priority Data

Nov. 23, 2015 (KR) ..... 10-2015-0163981

(51) Int. Cl.
*G09G 3/3233* (2016.01)
*G09G 3/3266* (2016.01)
*G09G 3/3275* (2016.01)

(52) U.S. Cl.
CPC ..... *G09G 3/3233* (2013.01); *G09G 3/3266* (2013.01); *G09G 3/3275* (2013.01);
(Continued)

(58) Field of Classification Search
CPC .. G09G 3/3233; G09G 3/3275; G09G 3/3266; G09G 2310/0251;
(Continued)

(56) References Cited

U.S. PATENT DOCUMENTS 7,911,423 B2 * 3/2011 Kim ..... G09G 3/3241 345/76
2006/0038762 A1 * 2/2006 Chou ..... G09G 3/325 345/92

(Continued)

FOREIGN PATENT DOCUMENTS

KR 10-2011-0039773 A 4/2011
KR 10-2014-0062862 A 5/2014
KR 10-2014-0102561 A 8/2014

*Primary Examiner* — Brent D Castiaux
(74) *Attorney, Agent, or Firm* — F. Chau & Associates, LLC

(57) ABSTRACT

An organic light-emitting diode (OLED) display is disclosed. In one aspect, the display includes a driving transistor having a gate electrode electrically connected to a first node and configured to supply a driving current to an OLED based on a voltage of the gate electrode. A storage capacitor electrically connects to the first node and is configured to maintain a constant voltage at the first node. A switching transistor electrically connects to the first node and includes a pair of transistors that are configured to be simultaneously turned on based on a first control signal. The transistors are serially connected to each other via a second node, and a current path circuit electrically connects to the second node and is configured to receive a charge stored in a capacitance of the second node when the switching transistor is turned off.

18 Claims, 15 Drawing Sheets

(52) U.S. Cl.
CPC ..... *G09G 2300/0861* (2013.01); *G09G 2300/0866* (2013.01); *G09G 2310/0251* (2013.01); *G09G 2310/0262* (2013.01); *G09G 2310/0289* (2013.01); *G09G 2310/08* (2013.01); *G09G 2320/0233* (2013.01)

(58) Field of Classification Search
CPC ... G09G 2310/0262; G09G 2310/0289; G09G 2310/08; G09G 2300/0861; G09G 2300/0866; G09G 2320/0233
See application file for complete search history.

(56) References Cited

U.S. PATENT DOCUMENTS

| | | | | |
|---|---|---|---|---|
| 2011/0084955 | A1 | 4/2011 | Kim | |
| 2011/0157144 | A1* | 6/2011 | Park | G09G 3/3233 345/212 |
| 2012/0019501 | A1* | 1/2012 | Choi | G09G 3/3233 345/211 |
| 2014/0225075 | A1* | 8/2014 | Zhan | H01L 29/78672 257/40 |
| 2015/0130691 | A1 | 5/2015 | Jeon | |
| 2015/0138180 | A1 | 5/2015 | Park et al. | |
| 2015/0161966 | A1 | 6/2015 | Nakao et al. | |

* cited by examiner

ORGANIC LIGHT-EMITTING DIODE DISPLAY

CROSS-REFERENCE TO RELATED APPLICATION

This application claims the benefit of Korean Patent Application No. 10-2015-0163981, filed on Nov. 23, 2015, in the Korean Intellectual Property Office, the disclosure of which is incorporated herein in its entirety by reference.

BACKGROUND

Field

The described technology generally relates to an organic light-emitting diode (OLED) display.

Description of the Related Technology

An OLED display includes a matrix of pixels where each pixel has an OLED that has a luminance that varies due to a driving current. An OLED pixel circuit includes the OLED, a driving transistor to control, based on a voltage between a gate and a source, a current supplied to the OLED, and a switching transistor to transmit a data voltage for controlling the luminance of the OLED to the driving transistor. In order to maintain the luminance of the OLED constant during one frame, the voltage between the gate and the source of the driving transistor has to be maintained constant, and to do so, the pixel further includes a storage capacitor connected to the gate of the driving transistor.

In order to display a more vivid image, resolution of the OLED display will be is increased and the size of a pixel will be decreased. In order to decrease the size of the pixel, the capacity of the storage capacitor will also decrease.

Due to that, there can be a problem in which voltages of both terminals of the storage capacitor are significantly changed due to transition of a logic level of a gate signal or noise such as a transistor off current. As a result, the luminance of the OLED may be changed during one frame. During emission of the OLED, it is necessary for the voltages of both terminals of the storage capacitor to be held stable.

SUMMARY OF CERTAIN INVENTIVE ASPECTS

One inventive aspect relates to an OLED display including a pixel circuit in which voltages of both terminals of a storage capacitor in a pixel may be stably maintained.

Another aspect is an OLED display that includes an OLED, a driving transistor, a storage capacitor, a switching transistor, and a current path circuit. The driving transistor may be configured to have a gate connected to a first node, and to supply a driving current to the OLED, according to a voltage of the gate. The storage capacitor may be configured to be connected to the first node and to maintain a voltage of the first node constant. The switching transistor may be configured to be connected to the first node and to include a pair of transistors that are simultaneously turned on by a first control signal and are serially connected to each other via a second node. The current path circuit may be configured to be connected to the second node and to which charges stored in the second node are applied when the switching transistor is turned off.

The switching transistor may be turned off in response to a rising edge of the first control signal. The second node may be coupled to the rising edge of the first control signal, so that, when the switching transistor is turned off, an electric potential of the second node may be increased.

The switching transistor may transmit a data voltage to the first node, in response to the first control signal. The current path circuit may include a current path transistor configured to apply a first voltage to the second node, in response to a second control signal.

During one frame, the current path transistor may be turned off before the switching transistor is turned off.

A level of the first voltage may be set to be lower than a voltage level of the first node.

The OLED display may further include an anode initialization transistor configured to apply the first voltage to an anode of the OLED, in response to the second control signal.

The OLED display may further include an anode initialization transistor configured to include a pair of transistors simultaneously turned on by a second control signal and serially connected to each other via a third node, to apply a first voltage to an anode of the OLED, in response to the second control signal, and to be turned off before the switching transistor is turned off, during one frame. The current path circuit may electrically and directly connect the second node and the third node to each other.

The OLED display may further include a scan transistor configured to transmit a data voltage to a source of the driving transistor, in response to the first control signal. The switching transistor may connect, in response to the first control signal, the gate and a drain of the driving transistor so as to compensate for a threshold voltage of the driving transistor.

The OLED display may further include a gate initialization transistor configured to include a pair of transistors simultaneously turned on by a second control signal and serially connected to each other via a third node, to apply a first voltage to the first node, in response to the second control signal, and to be turned off before the switching transistor is turned off, during one frame.

The current path circuit may electrically and directly connects the second node and the third node to each other.

The OLED display may further include a first pixel and a second pixel that are adjacent to each other. Each of the first and second pixels may include the OLED, the driving transistor, the storage capacitor, the switching transistor, the scan transistor, and the gate initialization transistor. The current path may circuit electrically and directly connect a second node of the first pixel and a third node of the second pixel to each other.

The OLED display may further include an anode initialization transistor configured to apply the first voltage to an anode of the OLED, in response to a third control signal; and a pair of emission control transistors configured to transmit a driving voltage to the driving transistor, in response to a fourth control signal, and to supply the driving current to the OLED. When the pair of emission control transistors is turned off by the second control signal having a turn-off level, the second control signal, the first control signal, and the third control signal may sequentially have a turn-on level.

The current path circuit may include a current path transistor configured to apply a first voltage to the second node, in response to a second control signal, and to be turned off before the switching transistor is turned off, during one frame.

The OLED display may further include a scan transistor configured to transmit a data voltage to a third node, in response to the first control signal. The storage capacitor may be connected between the first node and the third node. The switching transistor may connect, in response to the first control signal, the gate and a drain of the driving transistor to each other so as to compensate for a threshold voltage of the driving transistor.

The OLED display may further include an anode initialization transistor configured to include a pair of transistors simultaneously turned on by a second control signal and serially connected to each other via a fourth node, and to apply a first voltage to an anode of the OLED, in response to the second control signal. The current path circuit may electrically and directly connects the second node and the fourth node to each other.

The current path circuit may include a current path transistor configured to apply the first voltage to the second node, in response to a second control signal, and to be turned off before the switching transistor is turned off, during one frame.

The OLED display may further include an anode initialization transistor configured to apply the first voltage to an anode of the OLED, in response to the second control signal; a reference voltage applying transistor configured to apply the first voltage to the third node, in response to a third control signal; and an emission control transistor configured to supply the driving current from the driving transistor to the OLED, in response to the third control signal.

Another aspect is an OLED display that includes an OLED, a driving transistor, a storage capacitor, and first and second switching transistors. The driving transistor may be configured to have a gate connected to a first node and to supply a driving current to the OLED, according to a voltage of the gate. The storage capacitor may be configured to be connected to the first node. The first switching transistor may be configured to be connected to the first node and to include a pair of transistors that are serially connected to each other via a second node and are simultaneously controlled. The second switching transistor may be configured to include a pair of transistors that are serially connected to each other via a third node and are simultaneously controlled, wherein the third node is directly connected to the second node.

During one frame, the second switching transistor may be turned off before the first switching transistor is turned off.

A first voltage having a level lower than a voltage level of the first node may be applied to one terminal of the second switching transistor.

Another aspect is an organic light-emitting diode (OLED) display comprising: an OLED; a driving transistor having a gate electrode electrically connected to a first node and configured to supply a driving current to the OLED based on a voltage of the gate electrode; a storage capacitor electrically connected to the first node and configured to maintain a constant voltage at the first node; a switching transistor electrically connected to the first node and comprising a pair of transistors that are configured to be simultaneously turned on based on a first control signal, wherein the transistors are serially connected to each other via a second node; and a current path circuit electrically connected to the second node and configured to receive a charge stored in a capacitance of the second node when the switching transistor is turned off.

In the above OLED display, the switching transistor is configured to be turned off in response to a rising edge of the first control signal, wherein a voltage of the second node is proportional to the rising edge of the first control signal.

In the above OLED display, the switching transistor is further configured to transmit a data voltage to the first node in response to the first control signal, wherein the current path circuit comprises a current path transistor configured to apply a first voltage to the second node in response to a second control signal.

In the above OLED display, the current path transistor is further configured to be turned off before the switching transistor is turned off during the period of one frame.

In the above OLED display, a level of the first voltage is lower than a voltage level of the first node.

The above OLED display further comprises an anode initialization transistor configured to apply the first voltage to an anode of the OLED in response to the second control signal.

The above OLED display further comprises an anode initialization transistor comprising a pair of transistors configured to be simultaneously turned on based on a second control signal, wherein the transistors are serially connected to each other via a third node and configured to apply a first voltage to an anode of the OLED in response to the second control signal, wherein the transistors are further configured to be turned off before the switching transistor is turned off during the period of one frame, and wherein the current path circuit is further configured to electrically connect the second and third nodes.

The above OLED display further comprises a scan transistor configured to transmit a data voltage to a source electrode of the driving transistor in response to the first control signal, wherein the switching transistor is configured to electrically connects the gate electrode and a drain electrode of the driving transistor in response to the first control signal so as to compensate for a threshold voltage of the driving transistor.

The above OLED display further comprises a gate initialization transistor comprising a pair of transistors configured to be simultaneously turned on based on a second control signal, wherein the pair of transistors are serially connected to each other via a third node and configured to apply a first voltage to the first node in response to the second control signal, and wherein the pair of transistors are configured to be turned off before the switching transistor is turned off during the period of one frame.

In the above OLED display, the current path circuit is configured to electrically connect the second and third nodes.

The above OLED display further comprises a first pixel and a second pixel that are adjacent to each other, wherein each of the first and second pixels comprises the OLED, the driving transistor, the storage capacitor, the switching transistor, the scan transistor, second and third nodes, and the gate initialization transistor, and wherein the current path circuit is configured to electrically connect the second node of the first pixel and the third node of the second pixel.

The above OLED display further comprises: an anode initialization transistor configured to apply the first voltage to an anode of the OLED in response to a third control signal; and a pair of emission control transistors configured to transmit a driving voltage to the driving transistor in response to a fourth control signal and supply the driving current to the OLED, wherein the second control signal, the first control signal, and the third control signal sequentially have a turn-on level when the emission control transistors are turned off based on the second control signal having a turn-off level.

In the above OLED display, the current path circuit comprises a current path transistor configured to i) apply a first voltage to the second node in response to a second control signal, and ii) be turned off before the switching transistor is turned off during the period of one frame.

The above OLED display further comprises a scan transistor configured to transmit a data voltage to a third node in response to the first control signal, wherein the storage capacitor is connected between the first and third nodes, and wherein the switching transistor is configured to electrically connect the gate electrode and a drain electrode of the driving transistor in response to the first control signal so as to compensate for a threshold voltage of the driving transistor.

The above OLED display further comprises an anode initialization transistor comprising a pair of transistors configured to be simultaneously turned on based on a second control signal, wherein the transistors are serially connected to each other via a fourth node and configured to apply a first voltage to an anode of the OLED in response to the second control signal, and wherein the current path circuit is configured to electrically connect the second and fourth nodes.

In the above OLED display, the current path circuit comprises a current path transistor configured to i) apply the first voltage to the second node in response to a second control signal and ii) be turned off before the switching transistor is turned off during the period of one frame.

The above OLED display further comprises: an anode initialization transistor configured to apply the first voltage to an anode of the OLED in response to the second control signal; a reference voltage applying transistor configured to apply the first voltage to the third node in response to a third control signal; and an emission control transistor configured to supply the driving current from the driving transistor to the OLED in response to the third control signal.

In the above OLED display, the first control signal includes a scan signal.

In the above OLED display, the current path circuit includes a current path transistor electrically connected between a reference voltage and the second node, wherein the current path transistor is configured to transfer a charge in the capacitance of the second node to a reference voltage based on a second control signal.

Another aspect is an organic light-emitting diode (OLED) display comprising: an OLED; a driving transistor having a gate electrode electrically connected to a first node and configured to supply a driving current to the OLED based on a voltage of the gate electrode; a storage capacitor electrically connected to the first node; a first switching transistor electrically connected to the first node and comprising a pair of transistors that are serially connected to each other via a second node and are configured to be simultaneously controlled; and a second switching transistor comprising a pair of transistors that are serially connected to each other via a third node and are configured to be simultaneously controlled, wherein the third node is directly connected to the second node.

In the above OLED display, the second switching transistor is configured to be turned off before the first switching transistor is turned off during the period of one frame.

In the above OLED display, the second switching transistor has a terminal configured to receive a first voltage having a level lower than a voltage level of the first node.

DETAILED DESCRIPTION OF CERTAIN INVENTIVE EMBODIMENTS

Figure 1:
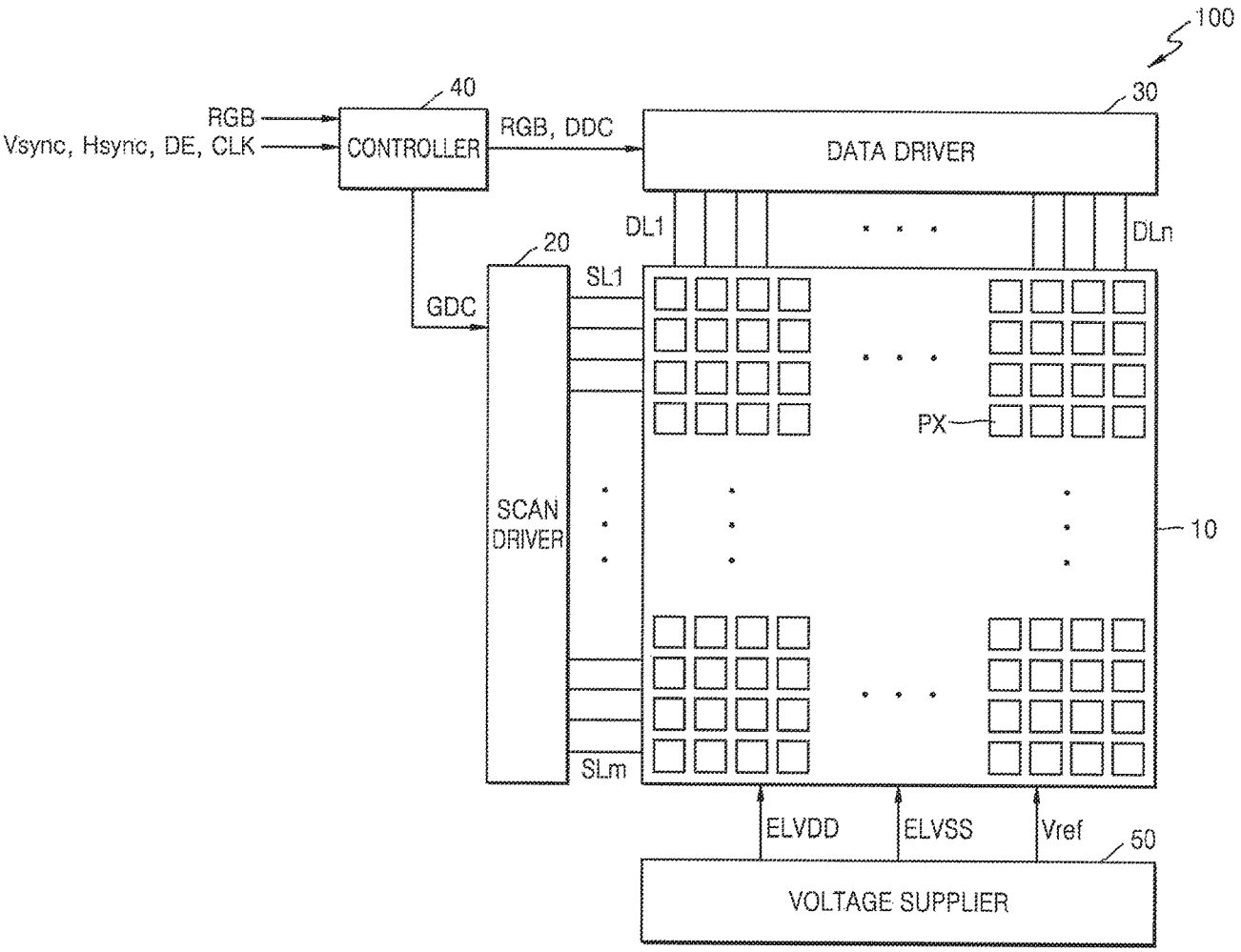
FIG. 1 illustrates a block diagram of an OLED display, according to an embodiment.

As the disclosure allows for various changes and numerous embodiments, particular embodiments will be illustrated in the drawings and described in detail in the written description. Effects and features of the disclosure and methods of accomplishing the same may be understood more readily by reference to the following detailed description of preferred embodiments and the accompanying drawings. The disclosure may, however, be embodied in many different forms and should not be construed as being limited to the embodiments set forth herein.

Reference will now be made in detail to embodiments, examples of which are illustrated in the accompanying drawings, wherein functions or constructions that are not related to descriptions are not described in detail since they would obscure the described technology with unnecessary detail, components that are the same or are in correspondence are rendered the same reference numeral regardless of the figure number, and redundant explanations are omitted.

While such terms as "first," "second," etc., may be used to describe various components, such components must not be limited to the above terms. The above terms are used only to distinguish one component from another. Throughout the specification, an expression used in the singular encompasses the expression of the plural, unless it has a clearly different meaning in the context.

Expressions such as "at least one of," when preceding a list of elements, modify the entire list of elements and do not modify the individual elements of the list. In this disclosure, the term "substantially" includes the meanings of completely, almost completely or to any significant degree under some applications and in accordance with those skilled in the art. Moreover, "formed, disposed or positioned over" can also mean "formed, disposed or positioned on." The term "connected" includes an electrical connection.

FIG. 1 illustrates a block diagram of an OLED display 100, according to an embodiment.

Referring to FIG. 1, the OLED display 100 includes a display unit 10, a scan driver 20, a data driver 30, a controller 40, and a voltage supplier 50. Depending on embodiments, certain elements may be removed from or additional elements may be added to the OLED display 100 illustrated in FIG. 1. Furthermore, two or more elements may be combined into a single element, or a single element may be realized as multiple elements. This also applies to the remaining disclosed embodiments.

The display unit 10 includes a plurality of pixels PX arrayed in a matrix form. Each of the pixels PX includes an OLED, a driving transistor having a gate connected to a first node, and supplying a driving current to the OLED according to a voltage of the gate, a storage capacitor connected to the first node and maintaining a voltage of the first node constant, a switching transistor connected to the first node, and including a pair of transistors that are substantially simultaneously turned on by a first control signal and are serially connected to each other via a second node, and a current path circuit connected to the second node and to which charges stored in the second node (or capacitance of the second node) are applied, when the switching transistor is turned off.

The pixel PX is connected to a scan line from among a plurality of scan lines SL1 through SLm and a data line from among a plurality of data lines DL1 through DLn. Each of the scan lines SL1 through SLm transmits control signals to the pixels PX of the same row, wherein the control signals are output from the scan driver 20, and each of the data lines DL1 through DLn transmits a data voltage to the pixels PX of the same column, wherein the data voltage is output from data driver 30. Referring to FIG. 1, each of the scan lines SL1 through SLm is illustrated as one line, but, according to a driving circuit of the pixel PX, each of the scan lines SL1 through SLm may include a plurality of lines for transmitting a plurality of control signals in a parallel manner.

Each of the pixels PX receives a first driving voltage ELVDD, a second driving voltage ELVSS, and a reference voltage Vref from the voltage supplier 50. The first and second driving voltages ELVDD and ELVSS are driving voltages to turn on the OLED, and the first driving voltage ELVDD may have a level higher than that of the second driving voltage ELVSS. The reference voltage Vref is necessary for an operation of the pixel PX, and may have a level similar to that of the second driving voltage ELVSS. The reference voltage Vref may be referred to as an initialization voltage Vinit according to the pixel PX.

Based on a data voltage transferred via a corresponding data line, the pixel PX may control a current that flows from the first driving voltage ELVDD to the second driving voltage ELVSS via the OLED. The data voltage means a signal or a voltage level of the signal that is transmitted via the corresponding data line. The OLED of the pixel PX emits light with a luminance corresponding to the data voltage. While the pixel PX corresponds to a part of a pixel capable of displaying a full color, e.g., a sub-pixel, for convenience of description, the pixel PX is referred to as a pixel, not the sub-pixel.

The controller 40 receives, from an external source, a vertical synchronization signal Vsync, a horizontal synchronization signal Hsync, a data enable signal Data Enable (DE), a clock signal CLK, and a data signal RGB. The controller 40 may control an operation timing of the scan driver 20 and the data driver 30 by using a timing signal such as the vertical synchronization signal Vsync, the horizontal synchronization signal Hsync, the data enable signal DE, the clock signal CLK, and the like. The controller 40 may determine a frame period by counting the data enable signals DE of one horizontal scanning period, and thus, the vertical and horizontal synchronization signals Vsync and Hsync that are provided from the external source may be skipped. The data signal RGB includes luminance information of the pixels PX. The luminance has a predetermined number of grayscale levels such as 1024(=210), 256(=28), or 64(=26) levels.

The controller 40 may generate a plurality of control signals including a gate timing control signal GDC for controlling an operation timing of the scan driver 20 and a data timing control signal DDC for controlling an operation timing of the data driver 30.

The gate timing control signal GDC may include a gate start pulse (GSP) signal, a gate shift clock (GSC) signal, a gate output enable (GOE) signal, and the like. The GSP signal is applied to the scan driver 20 where a first scan signal is generated. The GSC signal is a clock signal that is commonly input to the scan driver 20 so as to shift the GSP signal. The GOE signal controls an output of the scan driver 20.

The data timing control signal DDC may include a source start pulse (SSP) signal, a source sampling clock (SSC) signal, a source output enable (SOE) signal, and the like. The SSP signal controls a data sampling start point of the data driver 30. The SSC signal is a clock signal to control a data sampling operation in the data driver 30, according to a rising edge or a falling edge. The SOE signal controls an output of the data driver 30. The SSP signal applied to the data driver 30 may be skipped according to a data transmission scheme.

The scan driver 20 sequentially generates control signals to operate transistors of the pixels PX included in the display unit 10, in response to the gate timing control signal GDC from the controller 40. The scan driver 20 applies the control signals to the pixels PX included in the display unit 10, by using the scan lines SL1 through SLm. According to a design of a pixel PX, a plurality of control signals may be applied to the pixel PX. For example, first through fourth control signals are applied to the pixel PX in a set order during one frame.

The data driver 30 converts the digital-type data signal RGB to data in a parallel data system by sampling and latching the data signal RGB from the controller 40, in response to the data timing control signal DDC from the controller 40. When the data driver 30 converts the data signal RGB to the data in a parallel data system, the data driver 30 converts the digital-type data signal RGB to a gamma reference voltage and converts the gamma reference voltage to an analog-type data voltage. The data driver 30 supplies the data voltage to the pixels PX included in the display unit 10, by using the data lines DL1 through DLn.

Hereinafter, pixels according to various embodiments are described in detail.

Figure 2:
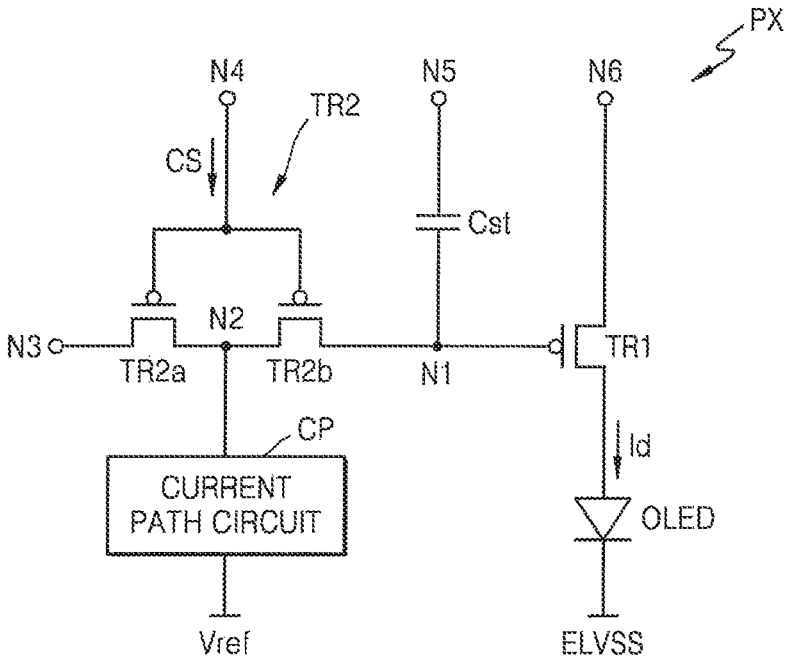
FIG. 2 illustrates a block diagram of a pixel, according to an embodiment.

FIG. 2 illustrates a block diagram of a pixel PX, according to an embodiment.

Referring to FIG. 2, the pixel PX includes an OLED, first and second transistors TR1 and TR2, a storage capacitor Cst, and a current path circuit CP.

The first transistor TR1 has a gate connected to a first node N1, and supplies a driving current ID to the OLED, according to a voltage of the gate. Amplitude of the driving current ID is determined according to voltages of the gate and a source of the first transistor TR1, but, when the voltage of the source of the first transistor TR1 is fixed, the amplitude of the driving current ID may be controlled according to the voltage of the gate of the first transistor TR1. The first transistor TR1 may be referred to as the driving transistor.

The first transistor TR1 may have a drain connected to an anode of the OLED, and a source connected to a sixth node N6. A first driving voltage ELVDD may be applied to the sixth node N6.

The storage capacitor Cst is connected between the first node N1 and a fifth node N5, and constantly maintains a voltage of the first node N1, e.g., the voltage of the gate of the first transistor TR1. The storage capacitor Cst may maintain the voltage of the gate of the first transistor TR1 constant during one frame, e.g., during an emission period after a data write period. As a result, the first transistor TR1 may supply the constant driving current ID to the OLED during the emission period, and the OLED may emit light with a constant luminance. The fifth node N5 may be connected to the source of the first transistor TR1, e.g., the sixth node N6. A first driving voltage ELVDD having a constant level may be applied to the fifth node N5.

The second transistor TR2 may be connected between the first node N1 and a third node N3 and may be controlled by a control signal CS supplied via a fourth node N4. The second transistor TR2 may include a pair of transistors TR2*a* and TR2*b* that are substantially simultaneously turned on by the control signal CS and are serially connected to each other. Gates of the pair of transistors TR2*a* and TR2*b* may be directly connected to each other. A node between the pair of transistors TR2*a* and TR2*b* is defined as a second node N2. The transistors TR2*a* and TR2*b* are connected to each other via the second node N2. The second transistor TR2 may be referred to as the switching transistor.

The second transistor TR2 may be, as shown in FIG. 2, a p-type metal-oxide-semiconductor field-effect transistor (MOSFET). When a control signal CS having a high level is applied to the second transistor TR2 via the fourth node N4, the second transistor TR2 may be turned off, and when a control signal CS having a low level is applied to the second transistor TR2, the second transistor TR2 may be turned on. Here, the high level may be referred to as a turn-off level and the low level may be referred to as a turn-on level. However, the disclosure is not limited thereto, and various technical concepts of the disclosure may be applied to a case in which the second transistor TR2 is an n-type MOSFET.

When a transistor is turned off, a current that passes the transistor is ideally 0 A. However, even if the transistor is actually turned off, the current that flows via the transistor is not 0 A, and the current may be referred to as a turn-off current. Since the second transistor TR2 is formed of the pair of transistors TR2*a* and TR2*b* that are serially connected, a turn-off current of the second transistor TR2 is relatively low. Therefore, an amount of charges, which are stored in the storage capacitor Cst, to be leaked via the second transistor TR2 is significantly small, so that the gate voltage of the first transistor TR1 may be maintained constant.

Since a size of the pixel PX is decreased, an area of the storage capacitor Cst is also decreased. Since a capacity of the storage capacitor Cst is decreased, even if a small amount of turn-off current is provided, voltages of both terminals of the storage capacitor Cst may be relatively significantly changed. As a result, the gate voltage of the first transistor TR1 may be changed, and a luminance of the OLED may also be changed.

When the second transistor TR2 is the p-type MOSFET, the second transistor TR2 is turned off, in response to a rising edge of the control signal CS. When the second transistor TR2 is turned off, the transistors TR2*a* and TR2*b* positioned in both sides of the second node N2 are turned off, so that the second node N2 substantially floats. According to a characteristic of an MOSFET, parasitic capacitance is present between the second node N2 and the gates of the transistors TR2*a* and TR2*b*. That is, while the second node N2 floats, if electric potentials of the gates of the transistors TR2*a* and TR2*b* are changed, an electric potential of the second node N2 is changed according to the electric potentials of the gates of the transistors TR2*a* and TR2*b*, due to the parasitic capacitance. Since the control signal CS is directly applied to the gates of the pair of transistors TR2*a* and TR2*b*, the second node N2 is coupled to the rising edge of the control signal CS due to the parasitic capacitance, and when the second transistor TR2 is turned off, the electric potential of the second node N2 is increased in response to the rising edge of the control signal CS.

The control signal CS is a signal for controlling the second transistor TR2, and e.g., has voltage variation of about 20 V. Thus, the electric potential of the second node N2 may also be increased by about 20 V when the second transistor TR2 is turned off. The electric potential of the second node N2 may become higher than an electric potential of the first node N1. For example, when the OLED emits light with a luminance corresponding to full-white, a voltage of the first node N1 may be lower by about 20 V than the increased electric potential of the second node N2. In this case, when a voltage between a source and a drain of the transistor TR2*b* is high, e.g., about 20 V, even if the transistor TR2*b* is turned off, a turn-off current with noticeable amplitude may flow from the second node N2 to the first node N1. A voltage of the first node N1 may be increased due to the turn-off current from the second node N2, the driving current ID may be decreased due to the increase in the gate voltage of the first transistor TR1, and the luminance of the OLED may deteriorate.

According to the present embodiment, the current path circuit CP is connected to the second node N2. When the second transistor TR2 is turned off, charges stored in the second node N2 are applied to the current path circuit CP. The charges stored in the second node N2 may be charges stored in the parasitic capacitance between the second node N2 and the gates of the transistors TR2*a* and TR2*b*. As described above, when the second transistor TR2 is turned off, the electric potential of the second node N2 which actually floats in response to the rising edge of the control signal CS is increased. The increase in the electric potential of the second node N2 occurs since the charges are stored in the parasitic capacitance between the second node N2 and the gates of the transistors TR2*a* and TR2*b*. The current path circuit CP allows the charges stored in the second node N2 to move to the current path circuit CP, not to move to the first node N1 via the turned off transistor TR2*b*.

The current path circuit CP may be connected to a reference voltage Vref, so that the charges stored in the second node N2 may not move to the first node N1 but may move to the current path circuit CP. The reference voltage Vref may be set to be lower than a voltage level of the first node N1. A voltage of the first node N1 may have the voltage level in a predetermined range, according to a data voltage applied to the pixel PX. The reference voltage Vref may be set to be lower than the voltage level that the first node N1 may have.

According to an embodiment, the current path circuit CP includes a current path transistor that applies the reference voltage Vref to the second node N2. According to another embodiment, the current path circuit CP includes a wire that directly connects the second node N2 to a particular position in the pixel PX.

According to an embodiment, the third node N3 may be connected to a data line that transmits the data voltage, and the fourth node N4 may be connected to a scan line that transmits a scan signal. In response to the scan signal transmitted to the fourth node N4, the second transistor TR2 may deliver, to the first node N1, the data voltage applied to the third node N3. In this case, the second transistor TR2 may be referred to as a scan transistor.

According to another embodiment, the third node N3 is connected to the drain of the first transistor TR1, and the fourth node N4 is connected to the scan line that transmits the scan signal. The second transistor TR2 may electrically connect the gate and the drain of the first transistor TR1, in response to the scan signal transmitted to the fourth node N4, so that the first transistor TR1 may be diode-connected. Since the second transistor TR2 diode-connects the first transistor TR1, a compensation voltage to which a threshold voltage of the first transistor TR1 has been added may be stored in the storage capacitor Cst. In this case, the second transistor TR2 may be referred to as a compensation transistor.

Figure 3A:
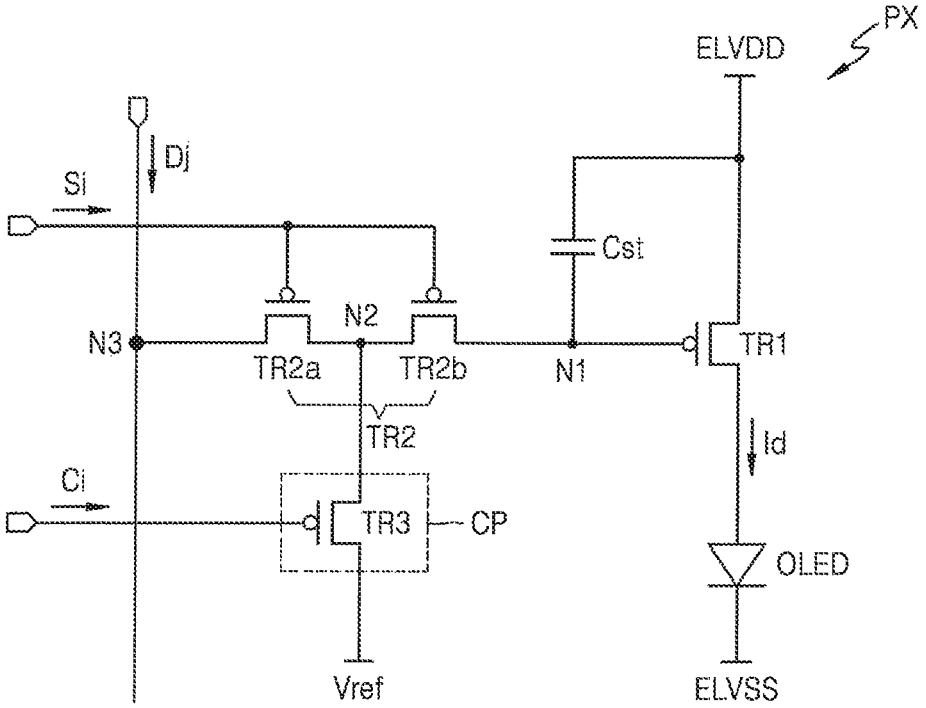
FIG. 3A illustrates a block diagram of a pixel, according to another embodiment.
Figure 3B:
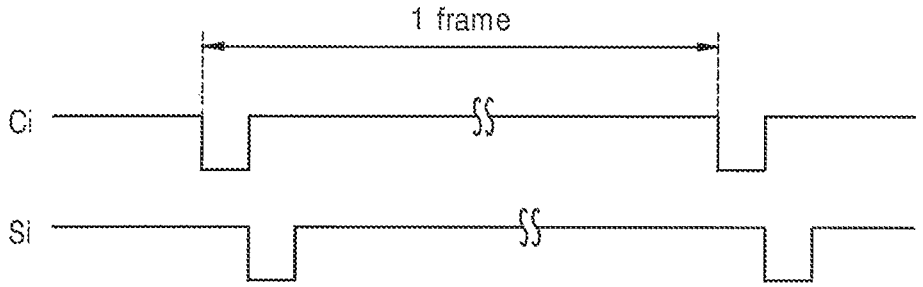
FIG. 3B illustrates a timing diagram with respect to an operation of the pixel shown in FIG. 3A.

FIG. 3A illustrates a block diagram of a pixel PX, according to another embodiment. FIG. 3B illustrates a timing diagram with respect to an operation of the pixel PX shown in FIG. 3A.

Referring to FIGS. 3A and 3B, the pixel PX includes an OLED, first and second transistors TR1 and TR2, a storage capacitor Cst, and a current path circuit CP. The current path circuit CP includes a third transistor TR3.

The first transistor TR1 has a gate connected to a first node N1, a source to which a first driving voltage ELVDD is applied, and a drain connected to an anode of the OLED. The first driving voltage ELVDD has a level that is substantially constant during an emission period of the OLED. The first transistor TR1 supplies a driving current ID to the OLED, according to a voltage of the gate. Amplitude of the driving current ID may be controlled by a gate voltage of the first transistor TR1. The first transistor TR1 may be referred to as a driving transistor.

The storage capacitor Cst is connected between the first node N1 and the source of the first transistor TR1, and constantly maintains a gate-source voltage of the first transistor TR1. Since the source voltage of the first transistor TR1 has a substantially constant level during the emission period of the OLED, the storage capacitor Cst may maintain the gate voltage of the first transistor TR1 constant during the emission period after a data write period. As a result, the first transistor TR1 may supply a constant driving current Id to the OLED during the emission period, and the OLED may emit light with a constant luminance.

The second transistor TR2 may be connected between the first node N1 and a third node N3. The third node N3 is connected to a data line to which a data voltage Dj is transmitted. The second transistor TR2 is controlled by a first control signal Si. The first control signal Si is transmitted via a scan line. The second transistor TR2 transmits the data voltage Dj to the first node N1, in response to the first control signal Si. The data voltage Dj transmitted to the first node N1 is stored in the storage capacitor Cst and is maintained during one frame. A period in which the data voltage Dj is transmitted to the first node N1 via the second transistor TR2 and then is stored in the storage capacitor Cst may be referred to as the data write period. A period in which the OLED emits light due to the driving current Id that is output from the first transistor TR1 according to a voltage of the first node N1 may be referred to as the emission period. The second transistor TR2 may operate as a switching transistor that switches connection between the first node N1 and the third node N3, in response to the first control signal Si, and may be referred to as a scan transistor.

The second transistor TR2 may include a pair of transistors TR2*a* and TR2*b* that are substantially simultaneously controlled by the first control signal Si and are serially connected to each other. Gates of the pair of transistors TR2*a* and TR2*b* may be directly connected to each other and may receive the first control signal Si. A node between the pair of transistors TR2*a* and TR2*b* is defined as a second node N2. The transistors TR2*a* and TR2*b* are connected to each other via the second node N2.

The second transistor TR2 may be a p-type MOSFET. The first and third transistors TR1 and TR3 other than the second transistor TR2 may also be p-type MOSFETs. The second transistor TR2 may be turned off in response to the first control signal Si with a high level and may be turned on in response to the first control signal Si with a low level. The second transistor TR2 is turned off in response to a rising edge of the first control signal Si. When the transistors TR2*a* and TR2*b* are turned off, the second node N2 substantially floats. Parasitic capacitance is present between the second node N2 and the gates of the transistors TR2*a* and TR2*b*. While the second node N2 substantially floats, if electric potentials of the gates of the transistors TR2*a* and TR2*b* are changed, an electric potential of the second node N2 is changed according to the electric potentials of the gates of the transistors TR2*a* and TR2*b*, due to the parasitic capacitance. The second node N2 is coupled to the rising edge of the first control signal Si due to the parasitic capacitance, and when the second transistor TR2 is turned off, the electric potential of the second node N2 is increased in response to the rising edge of the first control signal Si.

The first control signal Si has voltage variation of about 20 V so as to control the second transistor TR2. The electric potential of the second node N2 coupled to the first control signal Si may be increased by about 20 V when the second transistor TR2 is turned off. The electric potential of the second node N2 may become higher than an electric potential of the first node N1. Even if the transistor TR2*b* is turned off, a turn-off current with noticeable amplitude may flow from the second node N2 to the first node N1. The voltage of the first node N1 may be increased due to the turn-off current from the second node N2, the driving current ID may be decreased due to the increase in the gate voltage of the first transistor TR1, and the luminance of the OLED may deteriorate.

According to the present embodiment, the current path circuit CP is connected to the second node N2. When the second transistor TR2 is turned off, charges stored in the second node N2 are applied to the current path circuit CP. The charges stored in the second node N2 may be charges stored in the parasitic capacitance between the second node N2 and the gates of the transistors TR2*a* and TR2*b*. The current path circuit CP allows the charges stored in the second node N2 to move to the current path circuit CP, to not move to the first node N1 via the turned off transistor TR2*b*.

The current path circuit CP includes the third transistor TR3 that transmits a reference voltage Vref to the second node N2, in response to a second control signal Ci. The reference voltage Vref may be set to be lower than a voltage level of the first node N1. The third transistor TR3 may be referred to as a current path transistor. The third transistor TR3 may have substantially the same characteristic (e.g., an aspect ratio) as that of the transistor TR2*b*. According to another embodiment, the third transistor TR3 may have a turn-off current higher than that of the transistor TR2*b*.

The second control signal Ci has a turn-on level before the first control signal Si does, during one frame. The second control signal Ci may periodically have the turn-on level. When the one frame starts, the second control signal Ci first has the turn-on level, and when the second control signal Ci has a turn-off level, the first control signal Si may have the turn-on level. As a result, after the third transistor TR3 is first turned on for a short time period, the second transistor TR2 is turned on when the third transistor TR3 is turned off. The second transistor TR2 is turned off after a while. As described above, when the second transistor TR2 is turned on, the second transistor TR2 transmits the data voltage Dj to the first node N1.

During one frame, before the second transistor TR2 is turned off, the third transistor TR3 remains turned off. Therefore, the current path circuit CP is a circuit that connects the second node N2 to a voltage source of the reference voltage Vref via the turned off third transistor TR3, wherein the second node N2 substantially floats after the second transistor TR2 is turned off. As described above, the charges may be stored in the second node N2, according to the rising edge of the first control signal Si, and the charges stored in the second node N2 may move to the first node N1. However, according to the preset embodiment, the charges stored in the second node N2 may move to the voltage source of the reference voltage Vref via the turned off third transistor TR3. With respect to the second node N2, a level of the reference voltage Vref is lower than the voltage level of the first node N1, thus, the charges stored in the second node N2 may not move to the first node N1 via the turned off transistor TR2*b* but may move to the voltage source of the reference voltage Vref via the turned off third transistor TR3. Therefore, the amount of charges that move from the second node N2 to the first node N1 may be decreased, and voltage variation of the first node N1 may be decreased. The gate voltage of the first transistor TR1 may be maintained constant, the driving current Id may have constant amplitude, and the OLED may emit light with a constant luminance.

Figure 4:
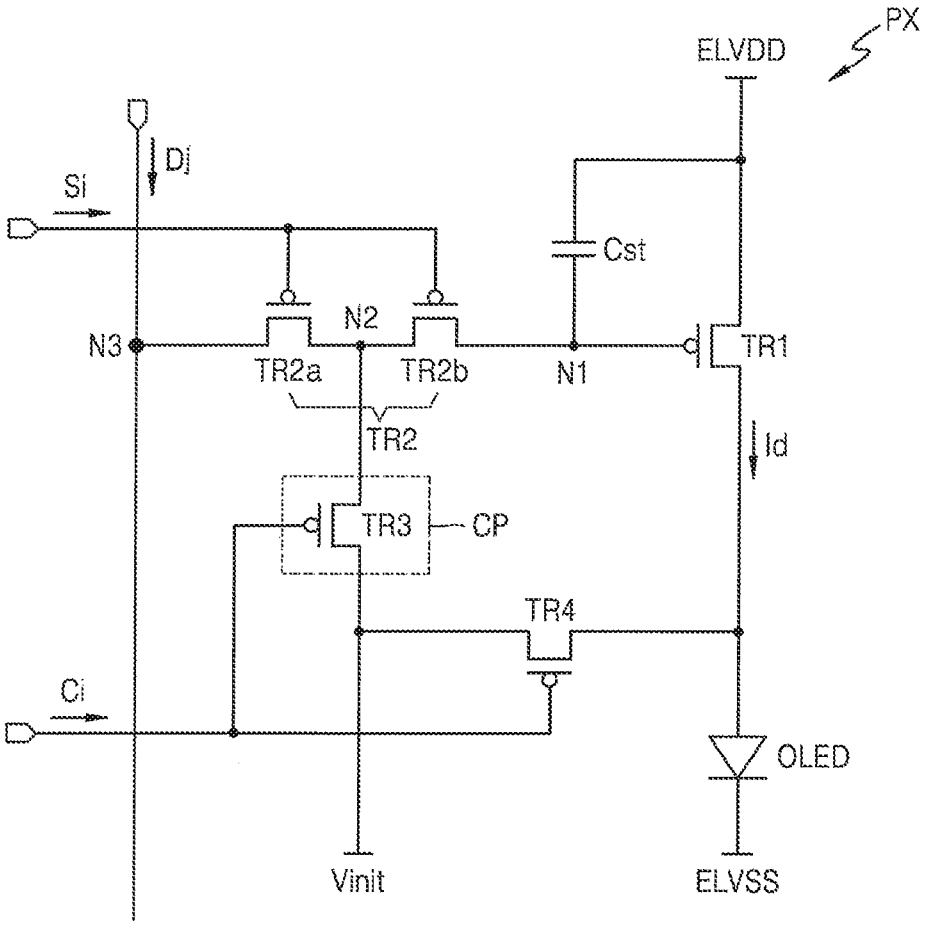
FIG. 4 illustrates a block diagram of a pixel, according to another embodiment.

FIG. 4 illustrates a block diagram of a pixel PX, according to another embodiment.

Referring to FIG. 4, the pixel PX includes an OLED, first, second, and fourth transistors TR1, TR2, and TR4, a storage capacitor Cst, and a current path circuit CP. The current path circuit CP includes a third transistor TR3.

The pixel PX may be controlled according to the timing diagram shown in FIG. 3B. The pixel PX according to the embodiment shown in FIG. 4 is substantially the same as the pixel PX according to the embodiment shown in FIG. 3A, except that the pixel PX according to the embodiment shown in FIG. 4 further includes a fourth transistor TR4. Thus, elements of the pixel PX which are equal to those previously described with reference to FIG. 3A are not repeatedly described here.

The fourth transistor TR4 may transmit an initialization voltage Vinit to an anode of the OLED, in response to a second control signal Ci. In order to prevent a problem in which charges remain at the anode of the OLED such that full-black is not completely displayed but a slight light is emitted, the initialization voltage Vinit may be applied to the anode of the OLED before a data write period starts. In order for the OLED to be turned off, a difference between the initialization voltage Vinit and a second driving voltage ELVSS may be lower than a threshold voltage of the OLED. A period in which the initialization voltage Vinit is transmitted to the anode of the OLED via the fourth transistor TR4 may be referred to as an anode initialization period. As shown in FIG. 3B, the anode initialization period is positioned before the data write period during one frame. The initialization voltage Vinit may be substantially the same as the reference voltage Vref of FIG. 3A, and may be set to be lower than the voltage level of the first node N1.

As described above, the third transistor TR3 operates in response to the second control signal Ci. That is, even before the data write period starts, the third transistor TR3 is turned off. Though charges are stored in a second node N2 that is coupled to a rising edge of a first control signal Si and thus substantially floats, the charges stored in the second node N2 may not move to the first node N1 via a turned off transistor TR2*b* but may move to a voltage source of the initialization voltage Vinit via the turned off third transistor TR3. Therefore, the amount of charges that move from the second node N2 to the first node N1 may be decreased, and voltage variation of the first node N1 may be decreased. A gate voltage of the first transistor TR1 may be maintained constant, the driving current Id may have constant amplitude, and the OLED may emit light with a constant luminance.

Figure 5:
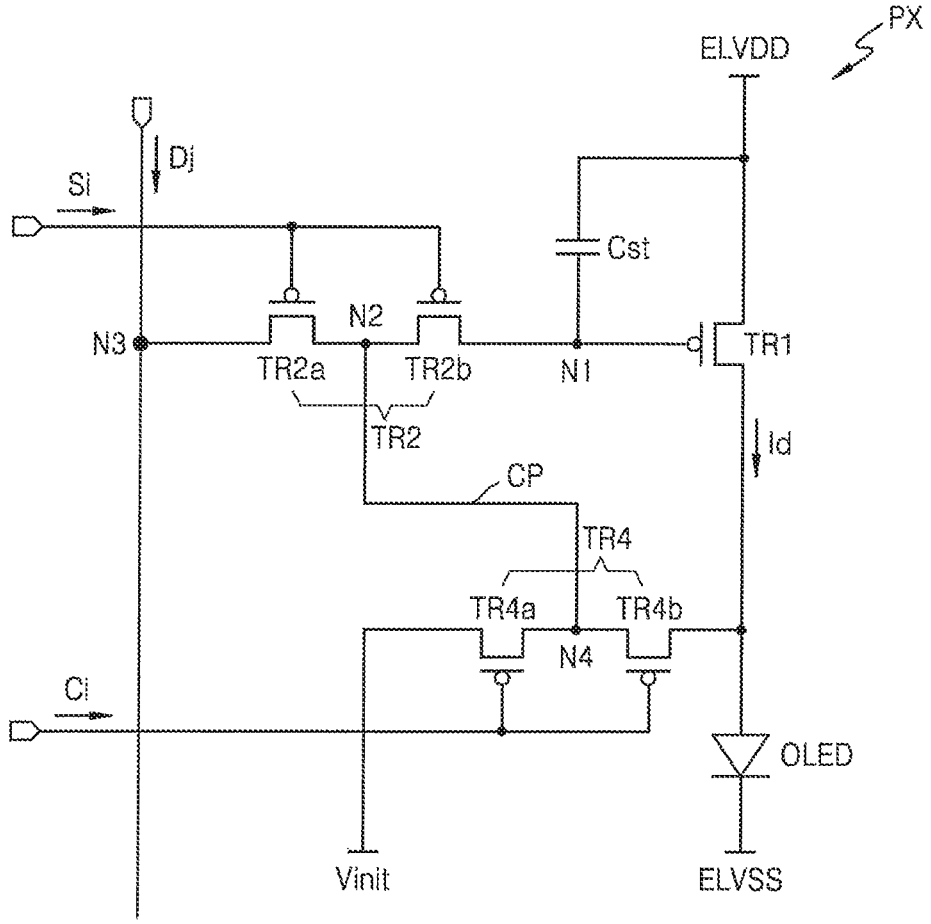
FIG. 5 illustrates a block diagram of a pixel, according to another embodiment.

FIG. 5 illustrates a block diagram of a pixel PX, according to another embodiment.

Referring to FIG. 5, the pixel PX includes an OLED, first, second, and fourth transistors TR1, TR2, and TR4, a storage capacitor Cst, and a current path circuit CP.

The pixel PX may be controlled according to the timing diagram shown in FIG. 3B. The pixel PX according to the embodiment shown in FIG. 5 is substantially the same as the pixel PX according to the embodiment shown in FIG. 4, except that the pixel PX according to the embodiment shown in FIG. 5 does not include a third transistor TR3, and includes the fourth transistor TR4 formed of a pair of transistors TR4*a* and TR4*b* that are serially connected. Thus, elements of the pixel PX which are equal to those previously described with reference to FIGS. 3A and 4 are not repeatedly described here.

The fourth transistor TR4 may transmit the initialization voltage Vinit to the anode of the OLED, in response to the second control signal Ci. The fourth transistor TR4 may include the pair of transistors TR4*a* and TR4*b* that are serially connected to each other. Gates of the pair of transistors TR4*a* and TR4*b* may be directly connected to each other and may receive the second control signal Ci. The transistors TR4*a* and TR4*b* are substantially simultaneously controlled by the second control signal Ci. A node between the pair of transistors TR4*a* and TR4*b* is defined as a fourth node N4. The transistors TR4*a* and TR4*b* are connected to each other via the fourth node N4.

The current path circuit CP is a wire that directly and electrically connects the second node N2 with the fourth node N4 between transistors TR2*a* and TR2*b* of the second transistor TR2. The fourth transistor TR4 operates in response to the second control signal Ci. That is, before a data write period starts, the fourth transistor TR4 is turned off. Even if the transistor TR4*a* of the fourth transistor TR4 is turned off, as described above, a turn-off current flows. Charges stored in the second node N2 may move to a voltage source of the initialization voltage Vinit via the turned off transistor TR4*a*. The transistor TR4*a* may operate in substantially the same manner as the third transistor TR3 of FIG. 4. The transistor TR4*a* may have substantially the same characteristic (e.g., an aspect ratio) as that of the transistor TR2*b*. According to another embodiment, the transistor TR4*a* may have a turn-off current higher than that of the transistor TR2*b*.

Though charges are stored in the second node N2 that is coupled to a rising edge of a first control signal Si and thus substantially float, the charges stored in the second node N2 may not move to the first node N1 via the turned off transistor TR2*b* but may move to the voltage source of the initialization voltage Vinit via the turned off transistor TR4*a*. Therefore, the amount of charges that move from the second node N2 to the first node N1 may be decreased, and voltage variation of the first node N1 may be decreased. A gate voltage of the first transistor TR1 may be maintained constant, a driving current Id may have constant amplitude, and the OLED may emit light with a constant luminance.

Figure 6:
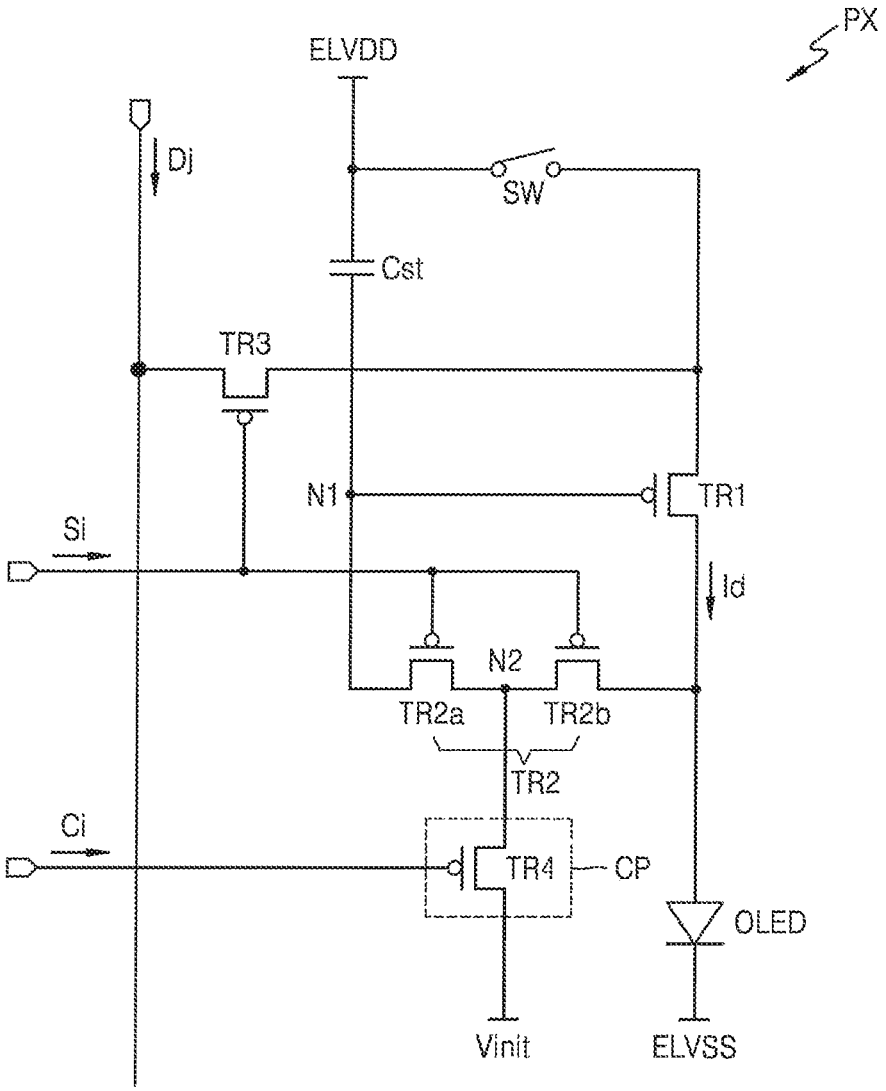
FIG. 6 illustrates a block diagram of a pixel, according to another embodiment.

FIG. 6 illustrates a block diagram of a pixel PX, according to another embodiment.

Referring to FIG. 6, the pixel PX includes an OLED, first, second, and third transistors TR1, TR2, and TR3, a storage capacitor Cst, a switch SW, and a current path circuit CP. The current path circuit CP includes a fourth transistor TR4. The pixel PX may be controlled according to the timing diagram shown in FIG. 3B.

The first transistor TR1 has a gate connected to a first node N1, a source to which a first driving voltage ELVDD is applied via the switch SW, and a drain connected to an anode of the OLED. The first transistor TR1 supplies a driving current Id to the OLED, according to a voltage of the gate. Amplitude of the driving current Id may be controlled by the gate voltage of the first transistor TR1. The first transistor TR1 may be referred to as a driving transistor.

The storage capacitor Cst has a first electrode connected to the first node N1 and a second electrode to which the first driving voltage ELVDD is applied, and constantly maintains the gate voltage of the first transistor TR1. Since the first driving voltage ELVDD is applied to the source of the first transistor TR1 via the switch SW, the storage capacitor Cst may maintain a gate-source voltage of the first transistor TR1 constant during an emission period after a data write period.

The third transistor TR3 is connected between a data line via which a data voltage Dj is transmitted and the source of the first transistor TR1. The third transistor TR3 is controlled by a first control signal Si. The first control signal Si is transmitted via a scan line. The third transistor TR3 transmits the data voltage Dj to the source of the first transistor TR1, in response to the first control signal Si. The third transistor TR3 may be referred to as a scan transistor.

The second transistor TR2 is connected to the first node N1, e.g., between the gate of the first transistor TR1 and the drain of the first transistor TR1. The second transistor TR2 is controlled by the first control signal Si. In response to the first control signal Si, the second transistor TR2 electrically connects the gate and the drain of the first transistor TR1, so that the first transistor TR1 may be diode-connected. Since the second transistor TR2 diode-connects the first transistor TR1, a compensation voltage to which a threshold voltage of the first transistor TR1 has been added is stored in the storage capacitor Cst. The second transistor TR2 may be referred to as a compensation transistor.

When the first control signal Si has a turn-on level, e.g., a low level, the second transistor TR2 and the third transistor TR3 are turned on. The data voltage Dj is applied to the source of the first transistor TR1 via the third transistor TR3. Here, the switch SW is open. The first transistor TR1 is diode-connected by the second transistor TR2 and is biased in a forward direction. As a result, a compensation voltage (Dj+Vth) obtained by adding the threshold voltage (Vth, where Vth is a negative value) of the first transistor TR1 to the data voltage Dj is applied to the first node N1. Since the compensation voltage is applied to the first electrode of the storage capacitor Cst, and a first driving voltage is applied to the second electrode of the storage capacitor Cst, when the switch SW is disconnected, the gate-source voltage of the first transistor TR1 becomes 'Dj+Vth−ELVDD'. During the emission period, the switch SW is disconnected, the driving current Id output from the first transistor TR1 has a value in proportion to a square (e.g., $(Dj-ELVDD)^2$) of a value obtained by subtracting the threshold voltage (e.g., Vth) from the gate-source voltage (e.g., Dj+Vth−ELVDD). That is, the driving current Id that is determined regardless of the threshold voltage (e.g., Vth) of the first transistor TR1 is output.

The second transistor TR2 may include a pair of transistors TR2*a* and TR2*b* that are substantially simultaneously turned on by the first control signal Si and are serially connected to each other. Gates of the pair of transistors TR2*a* and TR2*b* may be directly connected to each other, and may receive the first control signal Si. A node between the pair of transistors TR2*a* and TR2*b* is defined as a second node N2. The transistors TR2*a* and TR2*b* are connected to each other via the second node N2.

The second transistor TR2 may be a p-type MOSFET. The first, third, and fourth transistors TR1, TR3, and TR4 may also be p-type MOSFETs. The second transistor TR2 is turned off in response to a rising edge of the first control signal Si. When the transistors TR2*a* and TR2*b* are turned off, the second node N2 substantially floats. Parasitic capacitance is present between the second node N2 and the gates of the transistors TR2*a* and TR2*b*. While the second node N2 substantially floats, if electric potentials of the gates of the transistors TR2*a* and TR2*b* are changed, an electric potential of the second node N2 is changed according to the electric potentials of the gates of the transistors TR2*a* and TR2*b*, due to the parasitic capacitance. The second node N2 is coupled to the rising edge of the first control signal Si, and when the second transistor TR2 is turned off, the electric potential of the second node N2 is increased in response to the rising edge of the first control signal Si.

The first control signal Si has voltage variation of about 20 V so as to control the second transistor TR2. The electric potential of the second node N2 coupled to the first control signal Si may be increased by about 20 V when the second transistor TR2 is turned off. The electric potential of the second node N2 may become higher than an electric potential of the first node N1. Even if the transistor TR2*b* is turned off, a turn-off current with noticeable amplitude may flow from the second node N2 to the first node N1. The electric potential of the first node N1 may be increased due to the turn-off current from the second node N2, the driving current ID may be decreased due to the increase in the gate voltage of the first transistor TR1, and a luminance of the OLED may deteriorate.

According to the present embodiment, the current path circuit CP is connected to the second node N2. When the second transistor TR2 is turned off, charges stored in the second node N2 are applied to the current path circuit CP. The charges stored in the second node N2 may be charges stored in the parasitic capacitance between the second node N2 and the gates of the transistors TR2*a* and TR2*b*. The current path circuit CP allows the charges stored in the second node N2 to move to the current path circuit CP, not to move to the first node N1 via the turned off transistor TR2*a*.

The current path circuit CP includes the fourth transistor TR4 that transmits an initialization voltage Vinit to the second node N2, in response to a second control signal Ci. The initialization voltage Vinit may be set to be lower than a voltage level of the first node N1. The fourth transistor TR4 may be referred to as a current path transistor. The fourth transistor TR4 may have substantially the same characteristic (e.g., an aspect ratio) as that of the transistor TR2*a*. According to another embodiment, the fourth transistor TR4 may have a turn-off current higher than that of the transistor TR2*a*.

As shown in the timing diagram of FIG. 3B, during one frame, the second control signal Ci has a turn-on level before the first control signal Si does. During one frame, after the second transistor TR2 is first turned on, the first and third transistors TR1 and TR3 are turned on. Before the second and third transistors TR2 and TR3 are turned off in response to the rising edge of the first control signal Si, the fourth transistor TR4 is already turned off. Therefore, the current path circuit CP is a circuit that connects the second node N2 to a voltage source of the initialization voltage Vinit via the turned off fourth transistor TR4, wherein the second node N2 substantially floats after the second transistor TR2 is turned off.

The charges may be stored in the second node N2, according to the rising edge of the first control signal Si, and the charges stored in the second node N2 may move to the first node N1 via the turned off transistor TR2*a*. However, according to the preset embodiment, the charges stored in the second node N2 may move to the voltage source of the initialization voltage Vinit via the turned off fourth transistor TR4. With respect to the second node N2, a level of the initialization voltage Vinit is lower than the voltage level of the first node N1, thus, the charges stored in the second node N2 may not move to the first node N1 via the turned off transistor TR2*a* but may move to the voltage source of the initialization voltage Vinit via the turned off fourth transistor TR4. Therefore, the amount of charges that move from the second node N2 to the first node N1 may be decreased, and voltage variation of the first node N1 may be decreased. The gate voltage of the first transistor TR1 may be maintained constant, the driving current Id may have constant amplitude, and the OLED may emit light with a constant luminance.

Figure 7A:
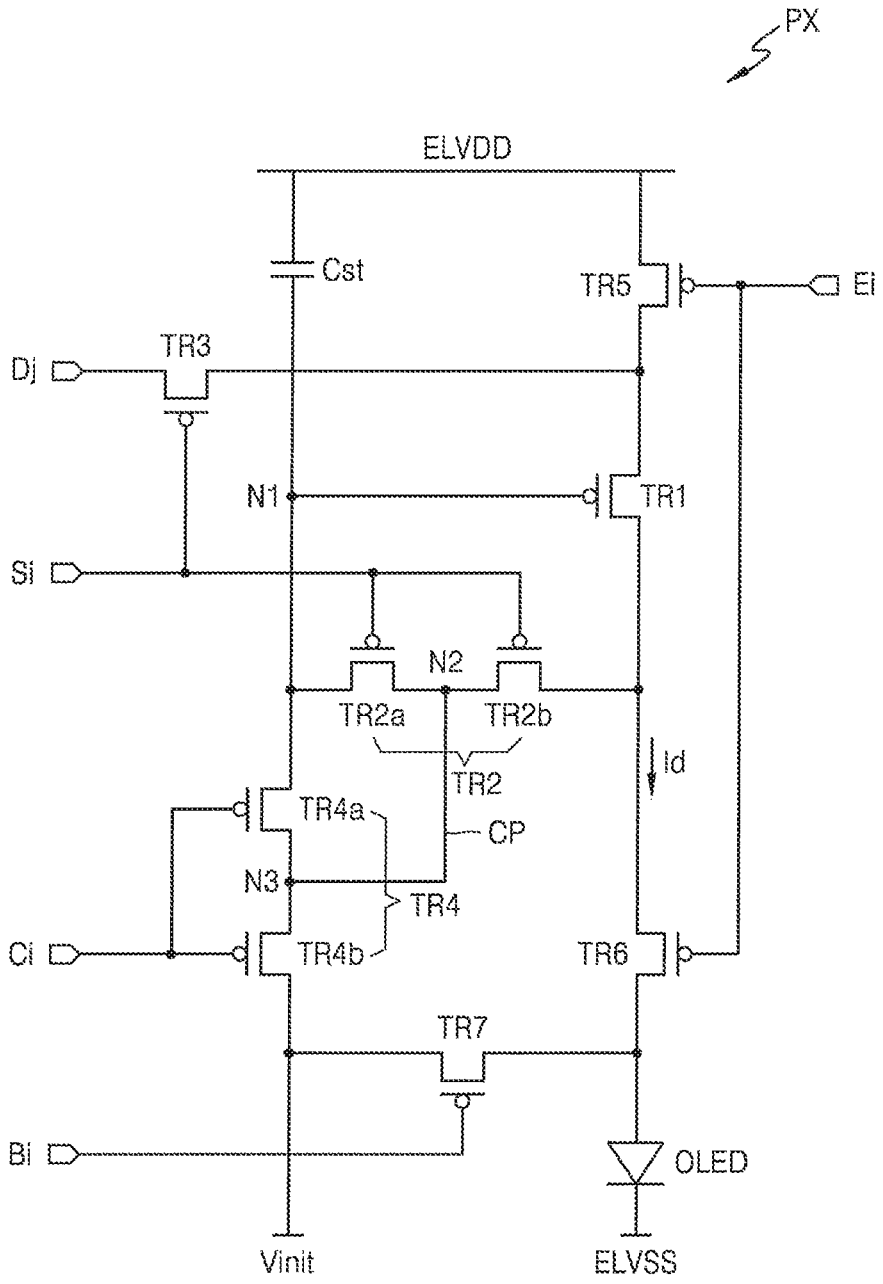
FIG. 7A illustrates a block diagram of a pixel, according to another embodiment.
Figure 7B:
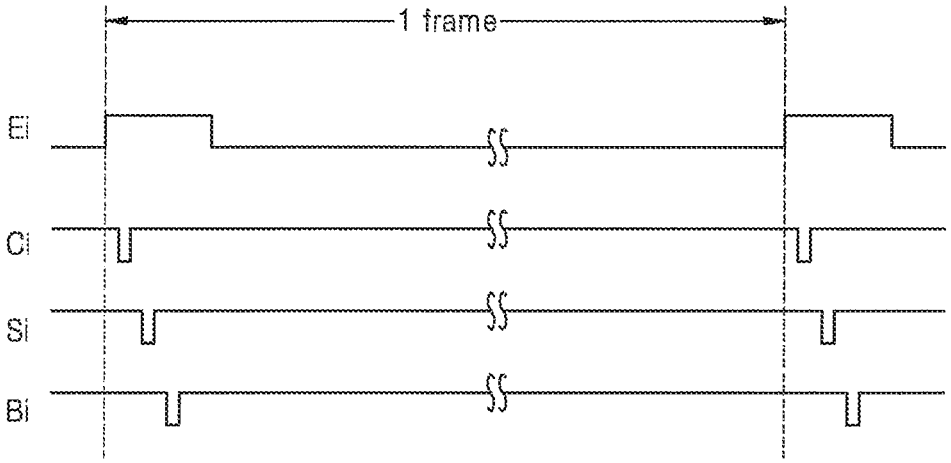
FIG. 7B illustrates a timing diagram with respect to an operation of the pixel shown in FIG. 7A.

FIG. 7A illustrates a block diagram of a pixel PX, according to another embodiment. FIG. 7B illustrates a timing diagram with respect to an operation of the pixel PX shown in FIG. 7A.

Referring to FIGS. 7A and 7B, the pixel PX includes an OLED, first through seventh transistors TR1 through TR7, a storage capacitor Cst, and a current path circuit CP. The first through third transistors TR1 through TR3 and the storage capacitor Cst of the pixel PX may be substantially the same as the first through third transistors TR1 through TR3 and the storage capacitor Cst of the pixel PX shown in FIG. 6.

The first transistor TR1 has a gate connected to a first node N1, a source to which a first driving voltage ELVDD is applied via the fifth transistor TR5, and a drain connected to an anode of the OLED. The first transistor TR1 supplies a driving current ID to the OLED, according to a voltage of the gate. Amplitude of the driving current ID may be controlled by a gate voltage of the first transistor TR1. The first transistor TR1 may be referred to as a driving transistor.

The storage capacitor Cst has a first electrode connected to the first node N1 and a second electrode to which the first driving voltage ELVDD is applied, and constantly maintains the gate voltage of the first transistor TR1.

The third transistor TR3 is connected between a data line via which a data voltage Dj is transmitted and the source of the first transistor TR1. The third transistor TR3 is controlled by a first control signal Si transmitted via a scan line. The third transistor TR3 transmits the data voltage Dj to the source of the first transistor TR1, in response to the first control signal Si. The third transistor TR3 may be referred to as a scan transistor.

The second transistor TR2 is connected between the gate and the drain of the first transistor TR1. The second transistor TR2 is controlled by the first control signal Si. In response to the first control signal Si, the second transistor TR2 electrically connects the gate and the drain of the first transistor TR1, so that the first transistor TR1 may be diode-connected. Since the second transistor TR2 diode-connects the first transistor TR1, a compensation voltage to which a threshold voltage of the first transistor TR1 has been added is stored in the storage capacitor Cst. The second transistor TR2 may be referred to as a compensation transistor.

The second transistor TR2 may include a pair of transistors TR2*a* and TR2*b* that are serially connected to each other. The transistors TR2*a* and TR2*b* are substantially simultaneously controlled by the first control signal Si and are connected to each other via a second node N2.

The fourth transistor TR4 is connected between the first node N1 and a voltage source of an initialization voltage Vinit. The fourth transistor TR4 is controlled by a second control signal Ci. The fourth transistor TR4 applies the initialization voltage Vinit to the first node N1, in response to the second control signal Ci, so that the fourth transistor TR4 may fully turn on the first transistor TR1. The initialization voltage Vinit may be set as a voltage capable of fully turning on the first transistor TR1. The fourth transistor TR4 may be referred to as a gate initialization transistor. The fourth transistor TR4 may include a pair of transistors TR4*a* and TR4*b* that are serially connected to each other. The transistors TR4*a* and TR4*b* are substantially simultaneously controlled by the second control signal Ci and are connected to each other via a third node N3.

The fifth transistor TR5 is connected between the source of the first transistor TR1 and a voltage source of the first driving voltage ELVDD. The fifth transistor TR5 is controlled by a third control signal Ei. The fifth transistor TR5 may apply the first driving voltage ELVDD to the first transistor TR1, in response to the third control signal Ei, so that the first transistor TR1 may generate the driving current Id.

The sixth transistor TR6 is connected between the drain of the first transistor TR1 and the OLED. The sixth transistor TR6 is controlled by the third control signal Ei. The sixth transistor TR6 connects the first transistor TR1 and the OLED, in response to the third control signal Ei, so that the driving current Id from the first transistor TR1 is provided to the OLED. The fifth and sixth transistors TR5 and TR6 may be referred to as emission control transistors.

The seventh transistor TR7 is connected between the OLED and the voltage source of the initialization voltage Vinit. The seventh transistor TR7 is controlled by a fourth control signal Bi. The seventh transistor TR7 applies the initialization voltage Vinit to the anode of the OLED, in response to the fourth control signal Bi, and thus may turn off the OLED. In order for the OLED to be turned off, a difference between the initialization voltage Vinit and a second driving voltage ELVSS may be lower than a threshold voltage of the OLED. The seventh transistor TR7 may be referred to as an anode initialization transistor.

As illustrated in FIG. 7A, the first through seventh transistors TR1 through TR7 may be p-type MOSFETs. However, the disclosure is not limited thereto, and at least one of the first through seventh transistors TR1 through TR7 may be an n-type MOSFET.

Referring to FIG. 7B, the timing diagrams of the first, second, third, and fourth control signals Si, Ci, Ei, and Bi during one frame are shown. As illustrated in FIG. 7A, it is assumed that the first through seventh transistors TR1 through TR7 are p-type MOSFETs.

When the third control signal Ei transitions to a turn-off level (a high level), the second control signal Ci, the first control signal Si, and the fourth control signal Bi sequentially have a turn-on level period. After the fourth control signal Bi transitions to a turn-off level (a high level), the third control signal Ei transitions to a turn-on level (a low level).

While the third control signal Ei has the turn-off level, the fifth and sixth transistors TR5 and TR6 that are controlled by the third control signal Ei are turned off. The first driving voltage ELVDD is not applied to the first transistor TR1 and the first transistor TR1 is disconnected from the OLED, so that the OLED does not emit light. A period in which the third control signal Ei has the turn-off level may be referred to as a non-emission period. On the contrary, a period in which the third control signal Ei has the turn-on level may be referred to as an emission period.

While the second control signal Ci has the turn-on level, the fourth transistor TR4 controlled by the second control signal Ci is turned on. When the initialization voltage Vinit is applied to the gate of the first transistor TR1, the first transistor TR1 is fully turned on. Since the first transistor TR1 is fully turned on in every frame, an inaccurate color expression due to a hysteresis characteristic of the first transistor TR1 may be improved. A period in which the second control signal Ci has the turn-on level may be referred to as a gate initialization period.

While the first control signal Si has the turn-on level, the second and third transistors TR2 and TR3 controlled by the first control signal Si are turned on. The data voltage Dj is applied to the source of the first transistor TR1 via the third transistor TR3, and the first transistor TR1 is diode-connected by the second transistor TR2. The compensation voltage obtained by adding the threshold voltage of the first transistor TR1 to the data voltage Dj is applied to the first node N 1 and is stored in the storage capacitor Cst. A period in which the first control signal Si has the turn-on level may be referred to as a data write period. Due to a circuit operation during the data write period, the threshold voltage of the first transistor TR1 may be compensated.

While the fourth control signal Bi has the turn-on level, the seventh transistor TR7 controlled by the fourth control signal Bi is turned on. Due to the seventh transistor TR7, the initialization voltage Vinit is applied to the anode of the OLED, so that the OLED is turned off. A period in which fourth control signal Bi has the turn-on level may be referred to as an anode initialization period.

The non-emission period, the gate initialization period, the data write period, and the anode initialization period sequentially proceed. When the emission period occurs, the first transistor TR1 provides, to the OLED, the driving current Id corresponding to the data voltage Dj according to the compensation voltage stored in the storage capacitor Cst, and then the OLED emits light with a luminance corresponding to the data voltage Dj.

Referring back to FIG. 7A, when the data write period ends, the second and third transistors TR2 and TR3 are turned off in response to the rising edge of the first control signal Si. When the transistors TR2*a* and TR2*b* are turned off, the second node N2 substantially floats. Parasitic capacitance is present between the second node N2 and the gates of the transistors TR2*a* and TR2*b*. While the second node N2 substantially floats, if electric potentials of the gates of the transistors TR2*a* and TR2*b* are changed, an electric potential of the second node N2 is changed according to the electric potentials of the gates of the transistors TR2*a* and TR2*b*, due to the parasitic capacitance. The second node N2 is coupled to the rising edge of the first control signal Si, and when the second transistor TR2 is turned off, the electric potential of the second node N2 is increased in response to the rising edge of the first control signal Si.

The first control signal Si has voltage variation of about 20 V so as to control the second transistor TR2. The electric potential of the second node N2 coupled to the first control signal Si may be increased by about 20 V when the second transistor TR2 is turned off. The electric potential of the second node N2 becomes higher than an electric potential of the first node N1. Even if the transistor TR2*b* is turned off, a turn-off current with noticeable amplitude may flow from the second node N2 to the first node N1. The electric potential of the first node N1 may be increased due to the turn-off current from the second node N2, the driving current ID may be decreased due to the increase in the gate voltage of the first transistor TR1, and a luminance of the OLED may deteriorate.

According to the present embodiment, the current path circuit CP is connected to the second node N2. When the second transistor TR2 is turned off, charges stored in the second node N2 are applied to the current path circuit CP. The charges stored in the second node N2 may be charges stored in the parasitic capacitance between the second node N2 and the gates of the transistors TR2*a* and TR2*b*. The current path circuit CP allows the charges stored in the second node N2 to move to the current path circuit CP, not to move to the first node N1 via the turned off transistor TR2*a*.

The current path circuit CP is a wire that directly and electrically connects the second node N2 and the third node N3 to each other. As described above, the third node N3 is a middle node of the fourth transistor TR4 to apply the initialization voltage Vinit to the first node N1 in response to the second control signal Ci, and is positioned between the transistors TR4*a* and TR4*b*. As described above, during one frame, the fourth transistor TR4 is already turned off before the second transistor TR2 is turned off. The initialization voltage Vinit is set to be lower than the voltage level of the first node N1.

The transistor TR4*b* of the fourth transistor TR4 may have substantially the same characteristic (e.g., an aspect ratio) as that of the transistor TR2*a*. According to another embodiment, the transistor TR4*b* may have a turn-off current higher than that of the transistor TR2*a*.

The charges are stored in the second node N2, according to the rising edge of the first control signal Si, and the charges stored in the second node N2 may move to the first node N1 via the turned off transistor TR2*a*. However, according to the present embodiment, the charges stored in the second node N2 may move to the voltage source of the initialization voltage Vinit via the turned off transistor TR4*b* of the fourth transistor TR4. With respect to the second node N2, a level of the initialization voltage Vinit is lower than the voltage level of the first node N1, thus, the charges stored in the second node N2 may not move to the first node N1 via the turned off transistor TR2*a* but may move to the voltage source of the initialization voltage Vinit via the turned off transistor TR4*b*. Therefore, the amount of charges that move from the second node N2 to the first node N1 may be decreased, and voltage variation of the first node N1 may be decreased. The gate voltage of the first transistor TR1 may be maintained constant, the driving current Id may have constant amplitude, and the OLED may emit light with a constant luminance.

In addition, during one frame, the fourth transistor TR4 is already turned off before the second transistor TR2 is turned off, thus, the third node N3 substantially floats before the second node N2 substantially floats. Parasitic capacitance is also present between the third node N3 and gates of the transistors TR4*a* and TR4*b*. According to the present embodiment, the second node N2 and the third node N3 are directly and electrically connected to each other, thus, not only the parasitic capacitance with respect to the gates of the transistors TR2*a* and TR2*b* but also the parasitic capacitance with respect to the gates of the transistors TR4*a* and TR4*b* are present at the second node N2. Thus, even if the electric potentials of the gates of the transistors TR2*a* and TR2*b* are changed, if electric potentials of the gates of the transistors TR4*a* and TR4*b* are not changed, the electric potential of the second node N2 is relatively less changed due to the parasitic capacitance with respect to the gates of the transistors TR4*a* and TR4*b*. Accordingly, even if the first control signal Si has voltage variation of about 20 V, when the second transistor TR2 is turned off, the electric potential of the second node N2 may be increased by about only 10 V. As a result, the amount of charges that move from the second node N2 to the first node N1 may be decreased.

Figure 8:
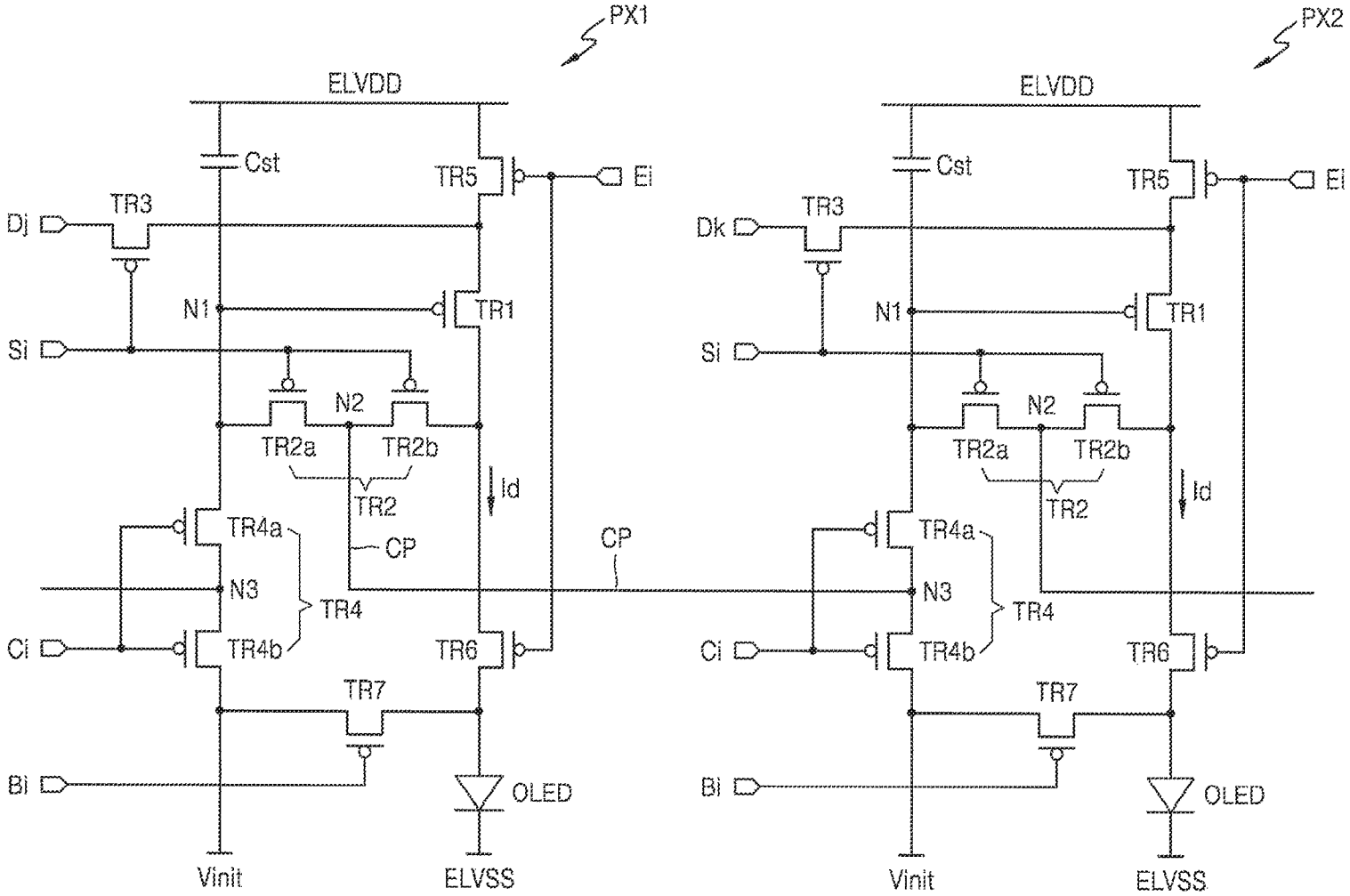
FIG. 8 illustrates a block diagram of two adjacent pixels, according to another embodiment.

FIG. 8 illustrates a block diagram of two adjacent pixels, according to another embodiment.

Referring to FIG. 8, first and second pixels PX1 and PX2 that are adjacent to each other in a row direction are shown. The second pixel PX2 is positioned in a right side of the first pixel PX1. A first data voltage Dj is applied to the first pixel PX1, and a second data voltage Dk is applied to the second pixel PX2. Each of the first and second pixels PX1 and PX2 is substantially the same as the pixel PX shown in FIG. 7A, except for a current path circuit CP. Thus, descriptions about same elements are not provided here.

As illustrated in FIG. 8, the current path circuit CP is a wire that directly connects a second node N2 of the first pixel PX1 to a third node N3 of the second pixel PX2. When the first and second pixels PX1 and PX2 are actually implemented on a substrate, it is better, on a layout, that the second node N2 of the first pixel PX1 is connected to the adjacent third node N3 of the second pixel PX2, rather than to a third node N3 of the first pixel PX1. Since control signals Si, Ci, and Bi of the same timing are applied to the first and second pixels PX1 and PX2, charges stored in the second node N2 of the first pixel PX1 do not move to a first node N1 via a turned off transistor TR2*a* of the first pixel PX1 but move to a voltage source of an initialization voltage Vinit via a turned off transistor TR4*b* of the second pixel PX2. Thus, the amount of charges that move from the second node N2 of the first pixel PX1 to the first node N1 of the first pixel PX1 may be decreased, and voltage variation of the first node N1 may be decreased. A gate voltage of a first transistor TR1 may be maintained constant, a driving current Id may have constant amplitude, and an OLED may emit light with a constant luminance.

Figure 9:
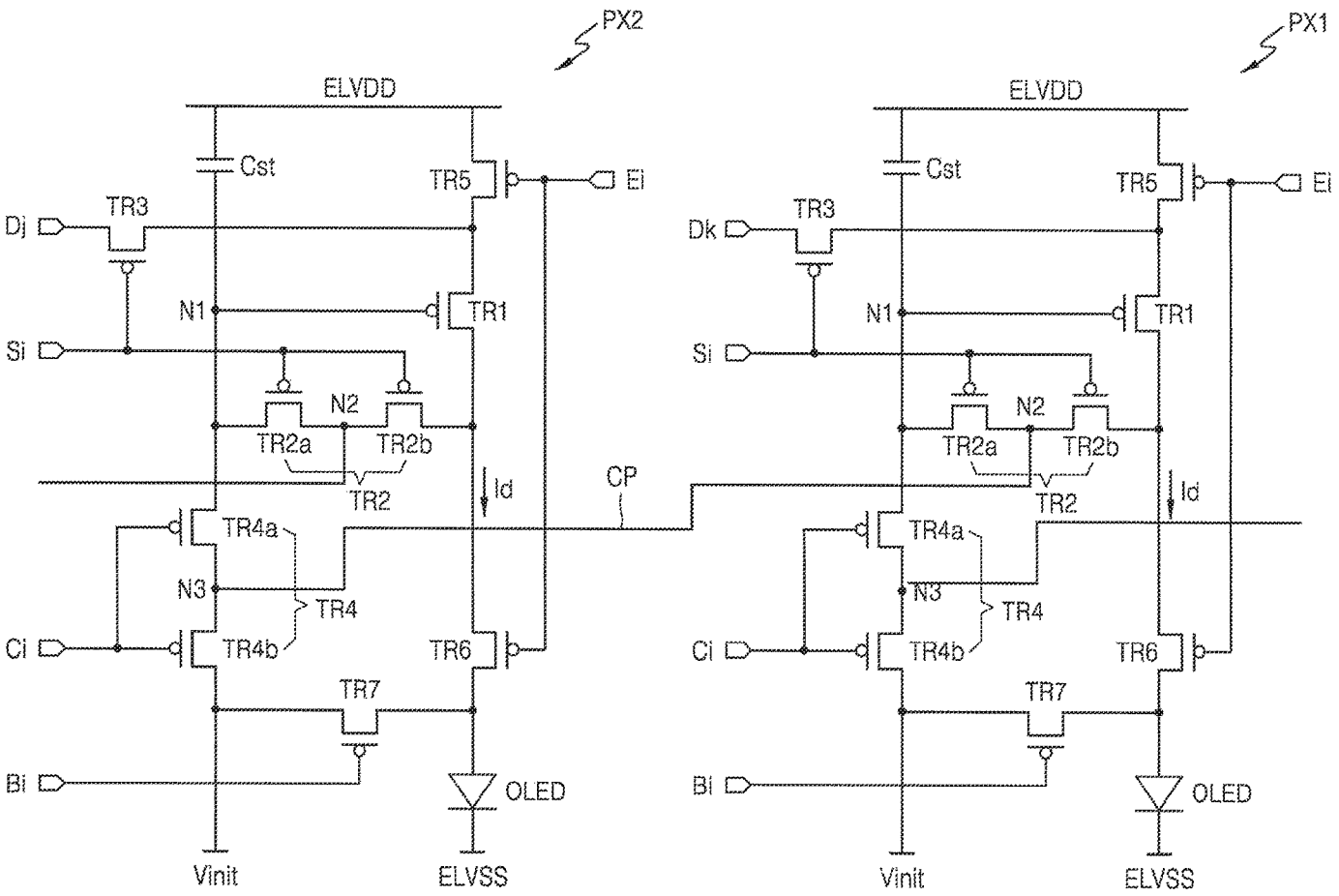
FIG. 9 illustrates a block diagram of two adjacent pixels, according to another embodiment.

FIG. 9 illustrates a block diagram of two adjacent pixels, according to another embodiment.

Referring to FIG. 9, first and second pixels PX1 and PX2 that are adjacent to each other in a row direction are shown. The second pixel PX2 is positioned in a left side of the first pixel PX1. A first data voltage Dj is applied to the first pixel PX1, and a second data voltage Di is applied to the second pixel PX2. Each of the first and second pixels PX1 and PX2 is substantially the same as the pixel PX shown in FIG. 7A, except for a current path circuit CP. Thus, descriptions about same elements are not provided here.

As illustrated in FIG. 9, the current path circuit CP is a wire that directly connects a second node N2 of the first pixel PX1 to a third node N3 of the second pixel PX2. When the first and second pixels PX1 and PX2 are actually implemented on a substrate, it is better, on a layout, that the second node N2 of the first pixel PX1 is connected to the adjacent third node N3 of the second pixel PX2, rather than to a third node N3 of the first pixel PX1. Since control signals Si, Ci, and Bi of the same timing are applied to the first and second pixels PX1 and PX2, charges stored in the second node N2 of the first pixel PX1 do not move to a first node N1 via a turned off transistor TR2*a* of the first pixel PX1 but move to a voltage source of an initialization voltage Vinit via a turned off transistor TR4*b* of the second pixel PX2. Thus, the amount of charges that move from the second node N2 of the first pixel PX1 to the first node N1 of the first pixel PX1 may be decreased, and voltage variation of the first node N1 may be decreased. A gate voltage of a first transistor TR1 may be maintained constant, a driving current Id may have constant amplitude, and an OLED may emit light with a constant luminance.

Figure 10:
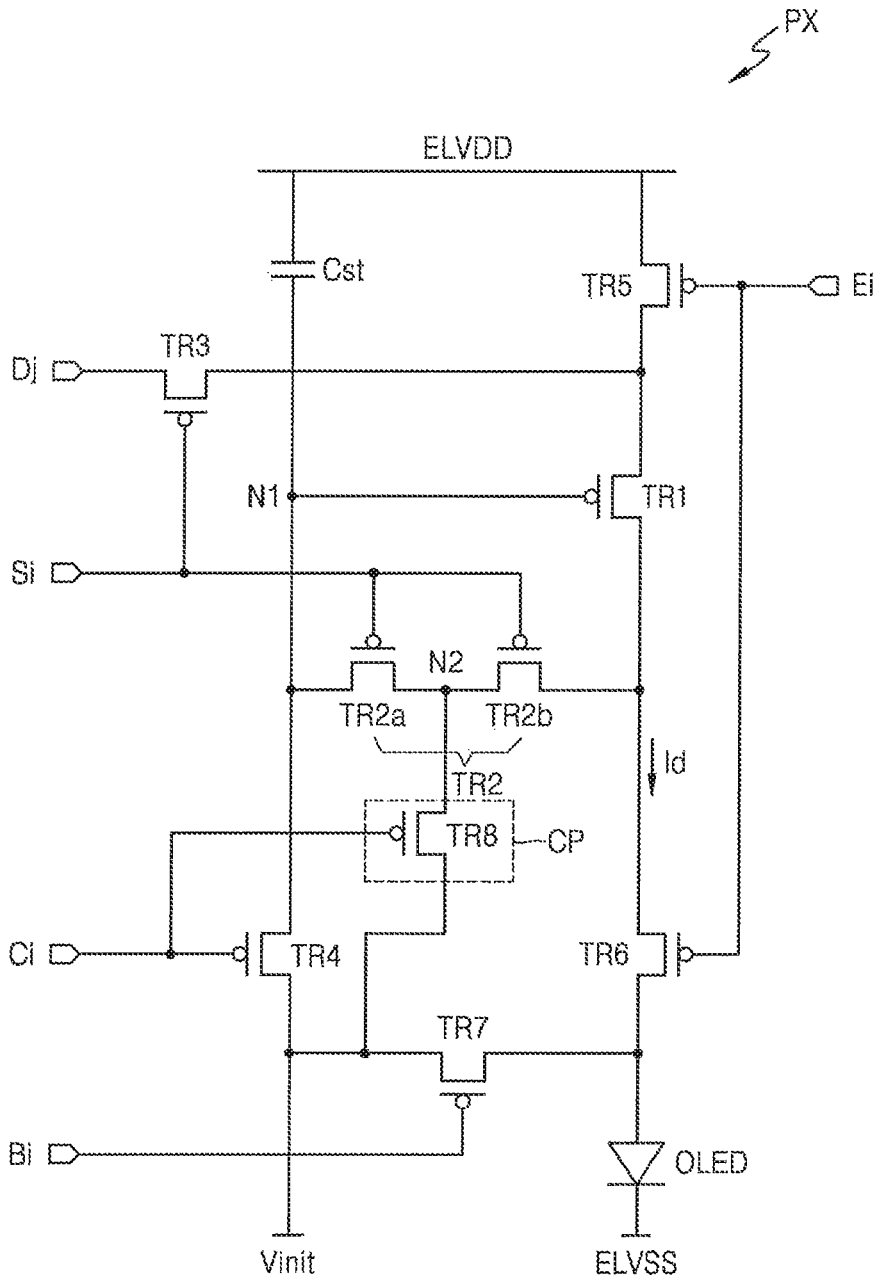
FIG. 10 illustrates a block diagram of a pixel, according to another embodiment.

FIG. 10 illustrates a block diagram of a pixel PX, according to another embodiment.

Referring to FIG. 10, the pixel PX includes an OLED, first through seventh transistors TR1 through TR7, a storage capacitor Cst, and a current path circuit CP. The current path circuit CP includes an eighth transistor TR8. The pixel PX may be controlled according to the timing diagram shown in FIG. 7B. The pixel PX is substantially the same as the pixel PX shown in FIG. 7A, except for the fourth transistor TR4 and the current path circuit CP. Thus, descriptions about same elements are not provided here.

The fourth transistor TR4 applies an initialization voltage Vinit to a first node N1, in response to a second control signal Ci. When the initialization voltage Vinit is applied to the first node N1, the first transistor TR1 is fully turned on. The initialization voltage Vinit may be set as a voltage capable of fully turning on the first transistor TR1. The fourth transistor TR4 may be referred to as a gate initialization transistor. According to another embodiment, the fourth transistor TR4 may include a pair of transistors TR4*a* and TR4*b* that are serially connected to each other.

The current path circuit CP includes the eighth transistor TR8 that transmits the initialization voltage Vinit to a second node N2, in response to the second control signal Ci. The initialization voltage Vinit may be set to be lower than a voltage level of the first node N1. The eighth transistor TR8 may be referred to as a current path transistor. The eighth transistor TR8 may have substantially the same characteristic (e.g., an aspect ratio) as that of a transistor TR2*a*. According to another embodiment, the eighth transistor TR8 may have a turn-off current higher than that of the transistor TR2*a*.

As illustrated in the timing diagram of FIG. 7B, before the second and third transistors TR2 and TR3 are turned off in response to a rising edge of a first control signal Si, the eighth transistor TR8 is already turned off. Therefore, the current path circuit CP is a circuit that connects the second node N2 to a voltage source of the initialization voltage Vinit via the turned off eighth transistor TR8, wherein the second node N2 substantially floats after the second transistor TR2 is turned off.

Charges may be stored in the second node N2, according to the rising edge of the first control signal Si, and the charges stored in the second node N2 may move to the first node N1 via the turned off transistor TR2*a*. However, according to the preset embodiment, the charges stored in the second node N2 may move to the voltage source of the initialization voltage Vinit via the turned off eighth transistor TR8. With respect to the second node N2, a level of the initialization voltage Vinit is lower than the voltage level of the first node N1, thus, the charges stored in the second node N2 may not move to the first node N1 via the turned off transistor TR2*a* but may move to the voltage source of the initialization voltage Vinit via the turned off eighth transistor TR8. Therefore, the amount of charges that move from the second node N2 to the first node N1 may be decreased, and voltage variation of the first node N1 may be decreased. The gate voltage of the first transistor TR1 may be maintained constant, a driving current Id may have constant amplitude, and the OLED may emit light with a constant luminance.

Figure 11A:
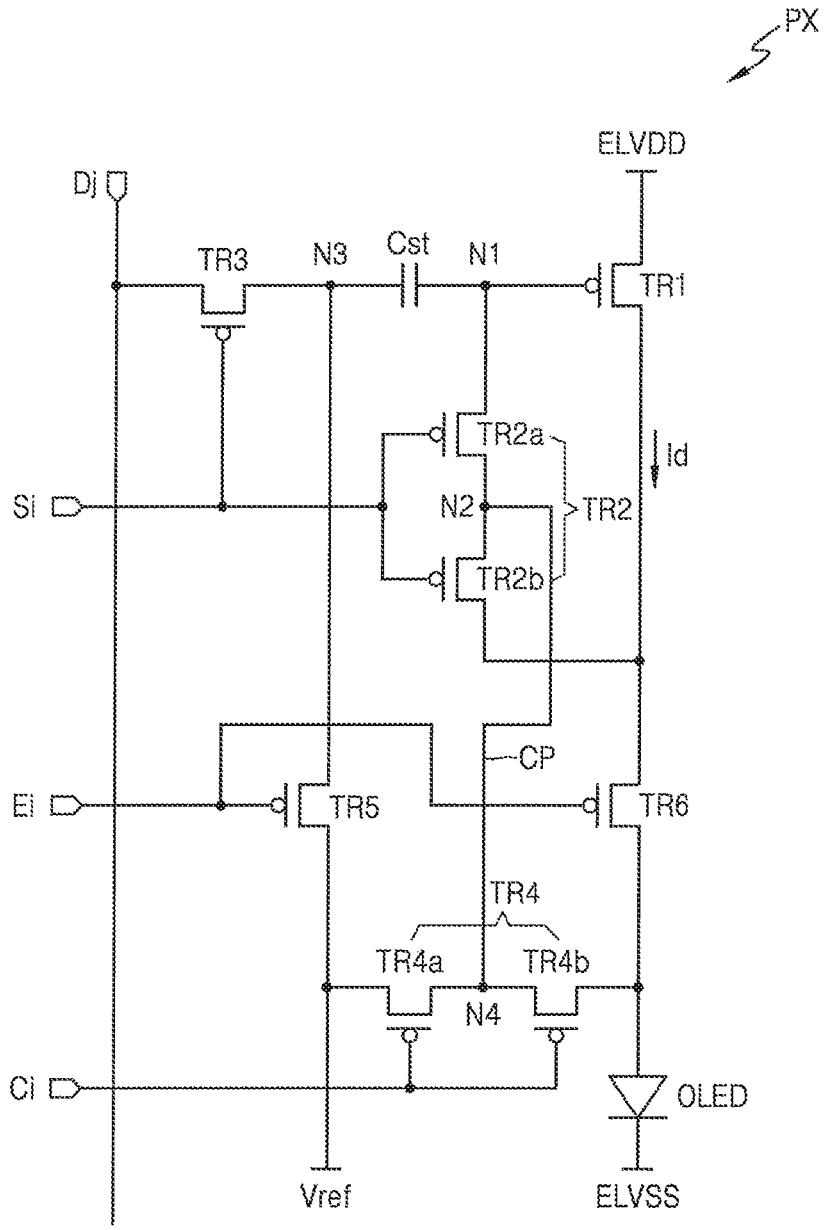
FIG. 11A illustrates a block diagram of a pixel, according to another embodiment.
Figure 11B:
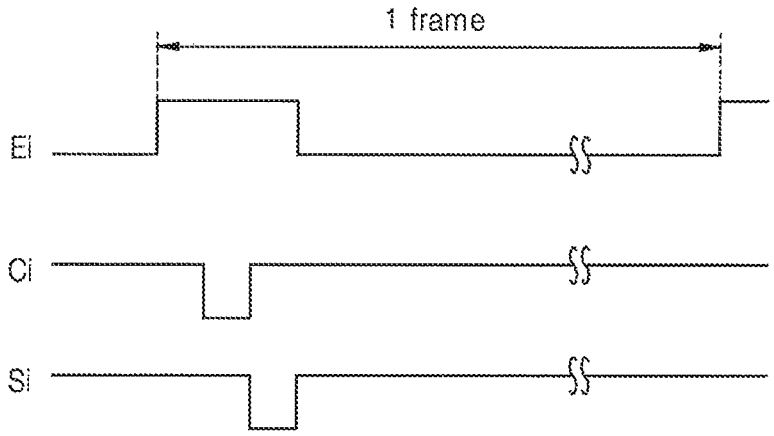
FIG. 11B illustrates a timing diagram with respect to an operation of the pixel shown in FIG. 11A.

FIG. 11A illustrates a block diagram of a pixel PX, according to another embodiment. FIG. 11B illustrates a timing diagram with respect to an operation of the pixel PX shown in FIG. 11A.

Referring to FIGS. 11A and 11B, the pixel PX includes an OLED, first through fifth transistors TR1 through TR5, a storage capacitor Cst, and a current path circuit CP. The pixel PX may be controlled according to the timing diagram shown in FIG. 11B.

The first transistor TR1 has a gate connected to a first node N1, a source to which a first driving voltage ELVDD is applied, and a drain connected to an anode of the OLED via a sixth transitory TR6. The first transistor TR1 supplies a driving current ID to the OLED, according to a voltage of the gate. Amplitude of the driving current ID may be controlled by a gate voltage of the first transistor TR1. The first transistor TR1 may be referred to as a driving transistor.

The storage capacitor Cst is connected between the first node N1 and a third node N3.

The second transistor TR2 is connected between the gate and the drain of the first transistor TR1. The second transistor TR2 is controlled by the first control signal Si. In response to the first control signal Si, the second transistor TR2 electrically connects the gate and the drain of the first transistor TR1, so that the first transistor TR1 may be diode-connected. The second transistor TR2 applies, by diode-connecting the first transistor TR1, a compensation voltage (Dj+Vth), which is obtained by adding a threshold voltage (Vth, where Vth is a negative value) of the first transistor TR1 to the first driving voltage ELVDD, to the first node N1. The second transistor TR2 may be referred to as a compensation transistor. The second transistor TR2 may include a pair of transistors TR2*a* and TR2*b* that are serially connected to each other. The transistors TR2*a* and TR2*b* are substantially simultaneously controlled by the first control signal Si and are connected to each other via a second node N2.

The third transistor TR3 transmits a data voltage Dj to the third node N3, in response to the first control signal Si. The third transistor TR3 may be referred to as a scan transistor.

The fourth transistor TR4 applies a reference voltage Vref to the anode of the OLED, in response to a second control signal Ci. When the reference voltage Vref is applied to the anode of the OLED, the OLED is turned off and thus is initialized. A difference between the reference voltage Vref and a second driving voltage ELVSS may be lower than a threshold voltage of the OLED. The fourth transistor TR4 may be referred to as an anode initialization transistor. The fourth transistor TR4 may include a pair of transistors TR4*a* and TR4*b* that are serially connected to each other. The transistors TR4*a* and TR4*b* are substantially simultaneously controlled by the second control signal Ci and are connected to each other via a fourth node N4.

The fifth transistor TR5 applies the reference voltage Vref to the third node N3, in response to a third control signal Ei. When the reference voltage Vref is applied to the third node N3, a voltage corresponding to the data voltage Dj is applied to the gate of the first transistor TR1. The fifth transistor TR5 may be referred to as a reference voltage applying transistor.

The sixth transistor TR6 connects the first transistor TR1 and the OLED, in response to the third control signal Ei, so that the driving current Id from the first transistor TR1 is supplied to the OLED. The sixth transistor TR6 may be referred to as an emission control transistor.

As illustrated in FIG. 11A, the first through sixth transistors TR1 through TR6 may be p-type MOSFETs. However, the disclosure is not limited thereto, and at least one of the first through sixth transistors TR1 through TR6 may be an n-type MOSFET.

Referring to FIG. 11B, the timing diagrams of the first, second, and third control signals Si, Ci, and Ei during one frame are shown When the third control signal Ei transitions to a turn-off level (a low level), the second control signal Ci and the first control signal Si sequentially have a turn-off level period.

While the third control signal Ei has the turn-off level, the fifth and sixth transistors TR5 and TR6 that are controlled by the third control signal Ei are turned off. The third node N3 floats, and the first transistor TR1 is disconnected from the OLED, so that the OLED does not emit light. A period in which the third control signal Ei has the turn-off level may be referred to as a non-emission period. On the contrary, a period in which the third control signal Ei has a turn-on level may be referred to as an emission period.

While the second control signal Ci has the turn-on level, the fourth transistor TR4 controlled by the second control signal Ci is turned on. The reference voltage Vref is applied to the anode of the OLED due to the fourth transistor TR4, so that the OLED is turned off. A period in which the second control signal Ci has the turn-on level may be referred to as an initialization period.

While the first control signal Si has the turn-on level, the second and third transistors TR2 and TR3 controlled by the first control signal Si are turned on. The data voltage Dj is applied to the third node N3 via the third transistor TR3, and the first transistor TR1 is diode-connected by the second transistor TR2, so that a compensation voltage (ELVDD+Vth) obtained by adding the threshold voltage (Vth) of the first transistor TR1 to the first driving voltage ELVDD is applied to the first node N1. A voltage (ELVDD+Vth−Dj) corresponding to a difference between a voltage (ELVDD+Vth) of the first node N1 and a voltage (Dj) of the third node N3 is stored in the storage capacitor Cst. A period in which the first control signal Si has the turn-on level may be referred to as a data write period. Due to a circuit operation during the data write period, the threshold voltage of the first transistor TR1 may be compensated.

When the third control signal Ei transitions to the turn-on level (a high level), the fifth and sixth transistors TR5 and TR6 that are controlled by the third control signal Ei are turned on. The reference voltage Vref is applied to the third node N3 by the fifth transistor TR5. A voltage (ELVDD+

Vth−Dj+Vref) obtained by adding the reference voltage Vref to the voltage (ELVDD+Vth−Dj) stored in the storage capacitor Cst is applied to the first node N1. The first transistor TR1 has a value in proportion to a square (e.g., $(Vref-Dj)^2$) of a value obtained by subtracting the threshold voltage (e.g., Vth) from a gate-source voltage (e.g., Vth−Dj+Vref). That is, the driving current Id that is determined regardless of the threshold voltage (e.g., Vth) of the first transistor TR1 is output.

The driving current Id of the first transistor TR1 is supplied to the OLED by the sixth transistor TR6, and the OLED emits light with a luminance corresponding to the data voltage Dj.

Referring back to FIG. 11A, when the data write period ends, the second and third transistors TR2 and TR3 are turned off in response to the rising edge of the first control signal Si. When the transistors TR2*a* and TR2*b* are turned off, the second node N2 substantially floats. Parasitic capacitance is present between the second node N2 and the gates of the transistors TR2*a* and TR2*b*. While the second node N2 substantially floats, if electric potentials of the gates of the transistors TR2*a* and TR2*b* are changed, an electric potential of the second node N2 is changed according to the electric potentials of the gates of the transistors TR2*a* and TR2*b*, due to the parasitic capacitance. The second node N2 is coupled to the rising edge of the first control signal Si, and when the second transistor TR2 is turned off, the electric potential of the second node N2 is increased in response to the rising edge of the first control signal Si.

The first control signal Si has voltage variation of about 20 V so as to control the second transistor TR2. The electric potential of the second node N2 coupled to the first control signal Si may also be increased by about 20 V when the second transistor TR2 is turned off. The electric potential of the second node N2 becomes higher than an electric potential of the first node N1. Even if the transistor TR2*b* is turned off, a turn-off current with noticeable amplitude may flow from the second node N2 to the first node N1. Since the turn-off current flows to the storage capacitor Cst, the voltage stored in the storage capacitor Cst may be increased due to the rising edge of the first control signal Si. During the emission period, the gate voltage of the first transistor TR1 may be increased, and the driving current Id may be decreased. A luminance of the OLED may deteriorate.

According to the present embodiment, the current path circuit CP is connected to the second node N2. When the second transistor TR2 is turned off, charges stored in the second node N2 are applied to the current path circuit CP. The charges stored in the second node N2 may be charges stored in the parasitic capacitance between the second node N2 and the gates of the transistors TR2*a* and TR2*b*. The current path circuit CP allows the charges stored in the second node N2 to move to the current path circuit CP, not to move to the first node N1 via the turned off transistor TR2*a*.

The current path circuit CP is a wire that directly and electrically connects the second node N2 and the fourth node N4 to each other. As described above, the fourth node N4 is a middle node of the fourth transistor TR4 controlled by the second control signal Ci, and is positioned between the transistors TR4*a* and TR4*b*. As described above, during one frame, the fourth transistor TR4 is already turned off before the second transistor TR2 is turned off. The reference voltage Vref is set to be lower than the voltage level of the first node N1. The transistor TR4*a* of the fourth transistor TR4 may have substantially the same characteristic (e.g., an aspect ratio) as that of the transistor TR2*a*. According to another embodiment, the transistor TR4*a* may have a turn-off current higher than that of the transistor TR2*a*.

The charges are stored in the second node N2, according to the rising edge of the first control signal Si, and the charges stored in the second node N2 may move to the first node N1 via the turned off transistor TR2*a*. However, according to the present embodiment, the charges stored in the second node N2 may move to a voltage source of the reference voltage Vref via the turned off transistor TR4*a* of the fourth transistor TR4. With respect to the second node N2, a level of the reference voltage Vref is lower than the voltage level of the first node N1, thus, the charges stored in the second node N2 may not move to the first node N1 via the turned off transistor TR2*a* but may move to the voltage source of the reference voltage Vref via the turned off transistor TR4*a*. Therefore, the amount of charges that move from the second node N2 to the first node N1 may be decreased, and voltage variation of the first node N1 may be decreased. The gate voltage of the first transistor TR1 may be maintained constant, the driving current Id may have constant amplitude, and the OLED may emit light with a constant luminance.

In addition, during one frame, the fourth transistor TR4 is already turned off before the second transistor TR2 is turned off, thus, the fourth node N4 substantially floats before the second node N2 substantially floats. Parasitic capacitance is also present between the fourth node N4 and gates of the transistors TR4*a* and TR4*b*. According to the present embodiment, the second node N2 and the fourth node N4 are directly and electrically connected to each other, thus, not only the parasitic capacitance with respect to the gates of the transistors TR2*a* and TR2*b* but also the parasitic capacitance with respect to the gates of the transistors TR4*a* and TR4*b* are present at the second node N2. Thus, even if the electric potentials of the gates of the transistors TR2*a* and TR2*b* are changed, if electric potentials of the gates of the transistors TR4*a* and TR4*b* are not changed, the electric potential of the second node N2 is relatively less changed due to the parasitic capacitance with respect to the gates of the transistors TR4*a* and TR4*b*. Accordingly, even if the first control signal Si has voltage variation of about 20 V, when the second transistor TR2 is turned off, the electric potential of the second node N2 may be increased by about only 10 V. As a result, the amount of charges that move from the second node N2 to the first node N1 may be decreased.

Figure 12:
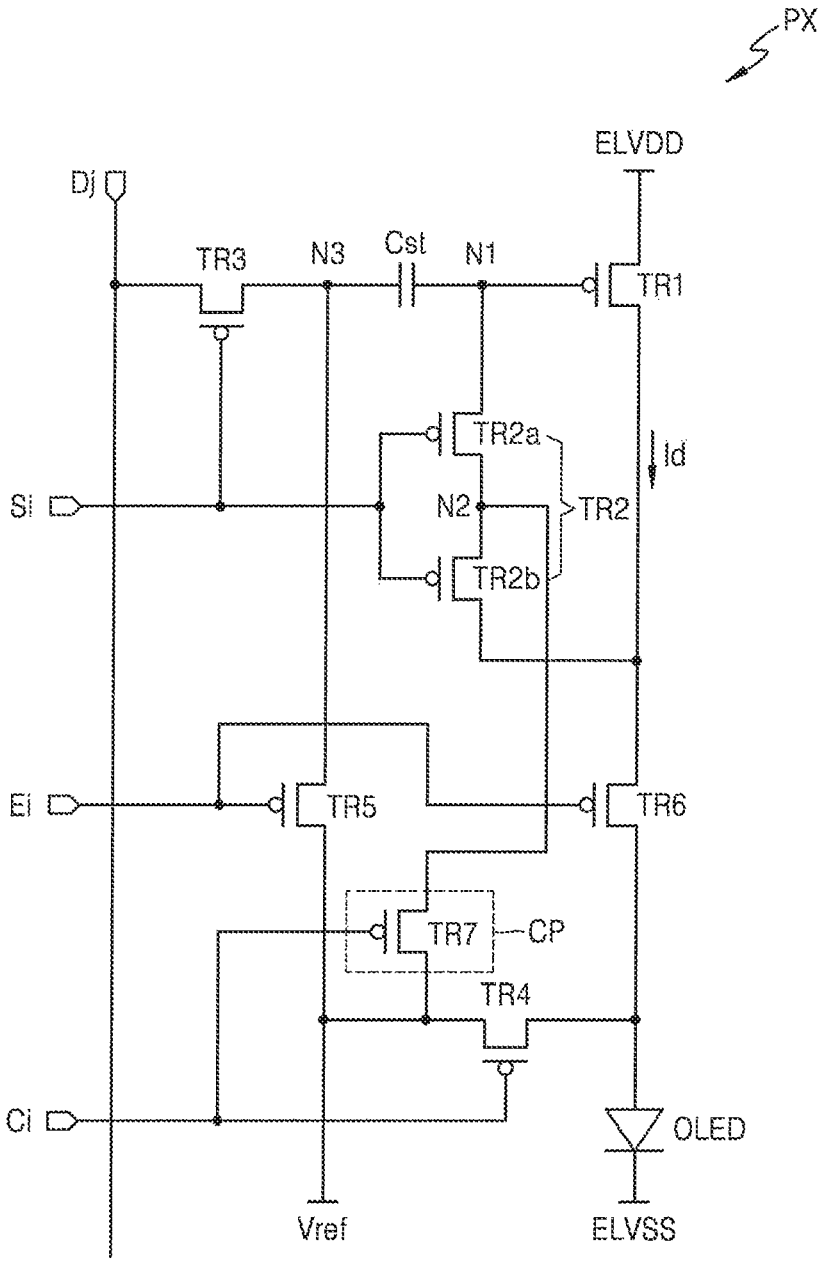
FIG. 12 illustrates a block diagram of a pixel, according to another embodiment.

FIG. 12 illustrates a block diagram of a pixel PX, according to another embodiment.

Referring to FIG. 12, the pixel PX includes an OLED, first through sixth transistors TR1 through TR6, a storage capacitor Cst, and a current path circuit CP. The current path circuit CP includes a seventh transistor TR7. The pixel PX may be controlled according to the timing diagram shown in FIG. 11B. The pixel PX is substantially the same as the pixel PX shown in FIG. 11A, except for the fourth transistor TR4 and the current path circuit CP. Thus, descriptions about same elements are not provided here.

The fourth transistor TR4 applies, in response to a second control signal Ci, a reference voltage Vref to an anode of the OLED. When the reference voltage Vref is applied to the anode of the OLED, the OLED is turned off and thus is initialized.

The current path circuit CP includes the seventh transistor TR7 that transmits the reference voltage Vref to a second node N2, in response to a second control signal Ci. The reference voltage Vref may be set to be lower than a voltage level of a first node N1. The seventh transistor TR7 may be referred to as a current path transistor. The seventh transistor TR7 may have substantially the same characteristic (e.g., an aspect ratio) as that of a transistor TR2*a*. According to another embodiment, the seventh transistor TR7 may have a turn-off current higher than that of the transistor TR2*a*.

As illustrated in the timing diagram of FIG. 11B, before the second and third transistors TR2 and TR3 are turned off in response to a rising edge of a first control signal Si, the seventh transistor TR7 is already turned off. Therefore, the current path circuit CP connects the second node N2 to a voltage source of the reference voltage Vref via the turned off seventh transistor TR7, wherein the second node N2 substantially floats after the second transistor TR2 is turned off.

Charges may be stored in the second node N2, according to the rising edge of the first control signal Si, and the charges stored in the second node N2 may move to the first node N1 via the turned off transistor TR2*a*. However, according to the preset embodiment, the charges stored in the second node N2 may move to the voltage source of the reference voltage Vref via the turned off seventh transistor TR7. With respect to the second node N2, a level of the reference voltage Vref is lower than the voltage level of the first node N1, and thus, the charges stored in the second node N2 may not move to the first node N1 via the turned off transistor TR2*a* but may move to the voltage source of the reference voltage Vref via the turned off seventh transistor TR7. Therefore, the amount of charges that move from the second node N2 to the first node N1 may be decreased, and voltage variation of the first node N1 may be decreased. The gate voltage of the first transistor TR1 may be maintained constant, a driving current Id may have constant amplitude, and the OLED may emit light with a constant luminance.

According to at least one of the disclosed embodiments, voltages of both terminals of a storage capacitor in a pixel may be stably maintained. Therefore, a luminance of an OLED may be maintained constant during one frame, and the OLED display according to various embodiments may have an improved image quality.

While the inventive technology has been described with reference to the figures, it will be understood by those of ordinary skill in the art that various changes in form and details may be made therein without departing from the spirit and scope as defined by the following claims.

What is claimed is:

1. An organic light-emitting diode (OLED) display comprising:

an OLED;

a driving transistor having a gate electrode electrically connected to a first node and configured to supply a driving current to the OLED based on a voltage of the gate electrode;

a storage capacitor electrically connected to the first node;

a scan transistor configured to transmit a data voltage to a source electrode of the driving transistor in response to a first control signal;

a switching transistor comprising a pair of transistors that are serially connected to each other via a second node and configured to be simultaneously turned on based on the first control signal, wherein the transistors are configured to electrically connect the gate electrode and a drain electrode of the driving transistor in response to the first control signal;

a gate initialization transistor comprising a pair of transistors that are serially connected to each other via a third node and configured to be simultaneously turned on based on a second control signal, wherein the pair of transistors are configured to apply a first voltage to the first node in response to the second control signal;

an anode initialization transistor configured to apply the first voltage to an anode of the OLED in response to a third control signal;

a pair of emission control transistors configured to transmit a driving voltage to the driving transistor and supply the driving current to the OLED in response to a fourth control signal; and a current path circuit electrically connected to the second node and configured to apply the first voltage to the second node in response to the second control signal, wherein the second control signal, the first control signal, and the third control signal sequentially have a turn-on level when the emission control transistors are turned off based on the fourth control signal having a turn-off level, and wherein the pair of transistors of the gate initialization transistor are configured to be turned off before the switching transistor is turned off during the period of one frame.

2. The OLED display of claim 1, wherein the switching transistor is configured to be turned off in response to a rising edge of the first control signal, and wherein a voltage of the second node is increased due to the rising edge of the first control signal when the switching transistor is turned off.

3. An organic light-emitting diode (OLED) display comprising:

an OLED;

a driving transistor having a gate electrode electrically connected to a first node and configured to supply a driving current to the OLED based on a voltage of the gate electrode;

a storage capacitor electrically connected to the first node;

a switching transistor directly connected between a data line and the first node to transmit a data voltage to the first node in response to a first control signal and comprising a pair of transistors that are serially connected to each other via a second node and configured to be simultaneously turned on based on the first control signal; and a current path circuit electrically connected to the second node, wherein the current path circuit comprises a current path transistor configured to apply a first voltage to the second node in response to a second control signal.

4. The OLED display of claim 3, wherein the current path transistor is further configured to be turned off before the switching transistor is turned off during the period of one frame.

5. The OLED display of claim 3, wherein a level of the first voltage is lower than a voltage level of the first node.

6. The OLED display of claim 3, further comprising an anode initialization transistor configured to apply the first voltage to an anode of the OLED in response to the second control signal.

7. The OLED display of claim 3, further comprising an anode initialization transistor comprising a pair of transistors configured to be simultaneously turned on based on the second control signal, wherein the transistors are serially connected to each other via a third node and configured to apply the first voltage to an anode of the OLED in response to the second control signal, wherein the transistors are further configured to be turned off before the switching transistor is turned off during the period of one frame, and wherein the current path transistor is one of the pair of transistors of the anode initialization transistor and the second and third nodes are electrically connected to each other.

8. The OLED display of claim 1, wherein the current path circuit is configured to electrically connect the second and third nodes.

9. The OLED display of claim 1, further comprising a first pixel and a second pixel that are adjacent to each other, wherein each of the first and second pixels comprises the OLED, the driving transistor, the storage capacitor, the switching transistor, the scan transistor, second and third nodes, and the gate initialization transistor, and wherein the current path circuit is configured to directly connect the second node of the first pixel and the third node of the second pixel.

10. The OLED display of claim 1, wherein the current path circuit comprises a current path transistor configured to i) apply the first voltage to the second node in response to the second control signal, and ii) be turned off before the switching transistor is turned off during the period of one frame.

11. An organic light-emitting diode (OLED) display comprising:

an OLED;

a driving transistor having a gate electrode electrically connected to a first node and configured to supply a driving current to the OLED based on a voltage of the gate electrode;

a switching transistor electrically connected to the first node and comprising a pair of transistors that are configured to be simultaneously turned on based on a first control signal, wherein the driving and switching transistors are serially connected to each other via a second node and configured to electrically connect the gate electrode and a drain electrode of the driving transistor in response to the first control signal;

a scan transistor directly connected between a data line and a third node and configured to transmit a data voltage to the third node in response to the first control signal;

a storage capacitor directly connected between the first and third nodes;

an anode initialization transistor configured to apply a first voltage to an anode of the OLED in response to a second control signal; and a current path circuit electrically connected to the second node, wherein the current path circuit comprises a current path transistor configured to apply the first voltage to the second node in response to the second control signal.

12. The OLED display of claim 11, wherein the anode initialization transistor comprises a pair of transistors configured to be simultaneously turned on based on the second control signal, wherein the transistors are serially connected to each other via a fourth node, and wherein the current path transistor is one of the pair of transistors of the anode initialization transistor and the second and fourth nodes are electrically connected to each other.

13. The OLED display of claim 11, wherein the current path transistor is configured to be turned off before the switching transistor is turned off during the period of one frame.

14. The OLED display of claim 11, further comprising:

a reference voltage applying transistor configured to apply the first voltage to the third node in response to a third control signal; and an emission control transistor configured to supply the driving current from the driving transistor to the OLED in response to the third control signal.

15. The OLED display of claim 1, wherein the first control signal includes a scan signal.

16. The OLED display of claim 1, wherein the current path circuit includes a current path transistor electrically connected between a reference voltage and the second node, and wherein the current path transistor is configured to transfer a charge in the capacitance of the second node to a reference voltage based on a second control signal.

17. The OLED display of claim 1, wherein the current path circuit is a conductor directly connected between the second and third nodes.

18. The OLED display of claim 1, wherein the current path circuit is a transistor configured to apply the voltage to the second node in response to the second control signal.

* * * * *